US008165816B2

(12) United States Patent
Searles et al.

(10) Patent No.: US 8,165,816 B2
(45) **Date of Patent: *Apr. 24, 2012**

(54) FLUID INJECTION MANAGEMENT METHOD FOR HYDROCARBON RECOVERY

(75) Inventors: Kevin H. Searles, Kingwood, TX (US); Ted A. Long, Sugar Land, TX (US); Rahul Pakal, Pearland, TX (US); Bruce A. Dale, Sugar Land, TX (US); Brian W. Duffy, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 586 days.

This patent is subject to a terminal disclaimer.

(21) Appl. No.: 12/375,162

(22) PCT Filed: Jul. 27, 2007

(86) PCT No.: PCT/US2007/017002

§ 371 (c)(1),
(2), (4) Date: Jan. 26, 2009

(87) PCT Pub. No.: WO2008/036153

PCT Pub. Date: Mar. 27, 2008

(65) Prior Publication Data

US 2010/0004906 A1 Jan. 7, 2010

Related U.S. Application Data

(60) Provisional application No. 60/845,847, filed on Sep. 20, 2006.

(51) Int. Cl.
*G01V 3/18* (2006.01)

(52) U.S. Cl. ..... 702/13; 702/9; 702/11; 702/27; 702/35; 702/183

(58) Field of Classification Search ..... 702/9, 11, 702/13, 27, 35, 183; 703/2, 10
See application file for complete search history.

(56) References Cited

U.S. PATENT DOCUMENTS 4,199,025 A 4/1980 Carpenter
4,279,299 A 7/1981 Shuck
(Continued)

FOREIGN PATENT DOCUMENTS

JP 2001-193069 7/2001
(Continued)

OTHER PUBLICATIONS

Bachman, R.C. et al., "Coupled Simulation of Reservoir Flow, Geomechanics, and Formation Plugging With Application to High-Rate Produced Water Reinjection," SPE 79695, (2003), pp. 1-9.

(Continued)

*Primary Examiner* — Michael Nghiem
*Assistant Examiner* — Elias Desta
(74) *Attorney, Agent, or Firm* — ExxonMobil Upstream Research Company—Law Department

(57) ABSTRACT

A method for controlling fluid injection parameters to improve well interactions and control hydrofracture geometries is provided. The method incorporates a systematic, transient analysis process for determining the formation effective displacement, stress and excess pore pressure field quantities at any depth within a stratified subterranean formation resulting from the subsurface injection of pressurized fluids.

19 Claims, 22 Drawing Sheets

U.S. PATENT DOCUMENTS

| | | | | |
|---|---|---|---|---|
| 4,374,544 | A | 2/1983 | Westerman et al. | |
| 4,475,591 | A | 10/1984 | Cooke, Jr. | |
| 4,678,033 | A | 7/1987 | Killough | |
| 4,721,158 | A | 1/1988 | Merritt, Jr. et al. | |
| 4,832,121 | A | 5/1989 | Anderson | |
| 4,953,137 | A | 8/1990 | Medlin | |
| 5,425,421 | A | 6/1995 | Coleman et al. | |
| 5,443,119 | A | 8/1995 | Chambers et al. | |
| 5,551,881 | A | 9/1996 | Henderson et al. | |
| 5,583,825 | A * | 12/1996 | Carrazzone et al. | 367/31 |
| 6,302,204 | B1 | 10/2001 | Reimers et al. | |
| 6,467,543 | B1 | 10/2002 | Talwani et al. | |
| 6,615,917 | B2 | 9/2003 | Bussear et al. | |
| 6,640,190 | B2 | 10/2003 | Nickel | |
| 6,754,589 | B2 | 6/2004 | Bush | |
| 6,832,158 | B2 | 12/2004 | Mese et al. | |
| 6,853,921 | B2 | 2/2005 | Thomas et al. | |
| 6,885,944 | B2 | 4/2005 | Davidson | |
| 6,904,366 | B2 | 6/2005 | Patzek et al. | |
| 6,913,079 | B2 | 7/2005 | Tubel | |
| 6,947,843 | B2 | 9/2005 | Fisher et al. | |
| 6,949,491 | B2 | 9/2005 | Cooke, Jr. | |
| 6,985,816 | B2 | 1/2006 | Sorrells et al. | |
| 6,988,547 | B2 | 1/2006 | Goodwin et al. | |
| 2002/0059048 | A1 | 5/2002 | Hardy et al. | |
| 2003/0051873 | A1 | 3/2003 | Patzek et al. | |
| 2004/0026076 | A1 | 2/2004 | Goodwin et al. | |
| 2004/0177955 | A1 | 9/2004 | Jogensen | |
| 2005/0236152 | A1 | 10/2005 | Siebrits et al. | |
| 2005/0238496 | A1 | 10/2005 | Mills | |
| 2006/0100837 | A1 | 5/2006 | Symington et al. | |
| 2006/0122777 | A1 | 6/2006 | Patzek et al. | |
| 2006/0224369 | A1 * | 10/2006 | Yang et al. | 703/10 |
| 2009/0292516 | A1 * | 11/2009 | Searles et al. | 703/10 |

FOREIGN PATENT DOCUMENTS

| | | | |
|---|---|---|---|
| WO | WO 98/49581 | A1 | 11/1998 |
| WO | WO 2006/064379 | A2 | 6/2006 |
| WO | WO 2007/067824 | A2 | 6/2007 |
| WO | WO 2008/036152 | A2 | 3/2008 |
| WO | WO 2008/036154 | A1 | 3/2008 |

OTHER PUBLICATIONS

Carter, R.D., "Derivation of the General Equation for Estimating the Extent of the Fractured Area," *Drilling and Production Practice, API*, (1957), pp. 267-268, New York, NY.

Marx, J.W. et al., "Reservoir Heating by Hot Fluid Injection," *Petroleum Transactions, AIME*, (1959), vol. 216, pp. 312-315.

Perkins, T.K. et al., "Widths of Hydraulic Fractures," Journal of Petroleum Technology, (Sep. 1961), pp. 937-949.

Searles, K.H. et al., "Earth Stress Analysis Method for Hydrocarbon Recovery", U.S. Appl. No. 12/375,196, filed Jan. 26, 2009.

Searles, K.H. et al., "Earth Stress Management and Control Process for Hydrocarbon Recovery", U.S. Appl. No. 12/375,195, filed Jan. 26, 2009.

Wang, Y. et al., "A Coupled Reservoir-Geomechanics Model and Applications to Wellbore Stability and Sand Prediction," SPE 69718, (2001), pp. 1-14.

Yale, D.P., Coupled Geomechanics-Fluid Flow Modeling: Effects of Plasticity and Permeability Alteration, SPE/ISRM 78202, (2002), pp. 1-10.

European Search Report No. 114554, Mar. 12, 2007, 2 pages.

PCT International Search Report & Written Opinion, Jul. 17, 2008, 7 pages.

* cited by examiner

FLUID INJECTION MANAGEMENT METHOD FOR HYDROCARBON RECOVERY

CROSS-REFERENCE TO RELATED APPLICATIONS

This application is the National Stage of International Application No. PCT/US07/17002, filed 27 Jul. 2007, which claims the benefit of U.S. Provisional Application No. 60/845,847, filed 20 Sep. 2006.

International patent application No. PCT/US07/16919, entitled "Earth Stress Management and Control Process for Hydrocarbon Recovery," published as WO 2008/036152, and International patent application No. PCT/US07/17003, entitled "Earth Stress Analysis Method for Hydrocarbon Recovery," published as WO 2008/036154, contain subject matter related to that disclosed herein, and are incorporated herein by reference in their entirety.

BACKGROUND OF THE INVENTION

1. Field of the Invention

Embodiments of the present invention relate generally to the analysis of earth stresses associated with hydrocarbon recovery and, more particularly, to determining effective displacements and stresses resulting from the injection and/or withdrawal of pressurized fluids.

2. Description of the Related Art

Hydrocarbon recovery processes may occur in subterranean reservoir sands or shales, may employ single or multiple water injection wells, and may be energetic by design. Recovery processes may require large pressure and/or temperature changes to promote the extraction of oil and gas at economic rates from subterranean formations. Water injection wells may be employed in either a secondary water flood strategy to sweep residual oil to production wells and provide pressure support, or strictly to dispose of produced water. The pressure or temperature changes, induced during the injection and/or withdrawal of pressurized fluids, result in stresses to the formation that may lead to some combination of fracturing, expansion and contraction of the subterranean formations.

These fracturing, expansion and contraction processes typically cause excess pore pressure and stress changes within the formations that may be large enough to negatively impact well mechanical integrity, productivity, injectivity and conformance. They may also be large enough to exceed the mechanical limits of penetrating wells. If the mechanical limits are exceeded, some combination of expansion and fracturing of the well or subterranean formation may occur. As a result, the penetrating wells may no longer be capable of sustaining reliable hydrocarbon production safely and without risk to the environment.

Many of the same risks are present in water flood or water disposal campaigns and success may depend on the capabilities to manage early water breakthrough and contain hydrofracture growth within the target subterranean interval(s). For water flooding, the expansion and fracturing process may lead to "short circuiting" of injector-producer patterns and loss of pressure support. For water disposal, these processes may lead to a loss of containment that may result in repressurization of untargeted zones and, potentially, regulatory and environmental consequences.

Prior art methods employed for analysis of earth stresses associated with the injection or production of hydrocarbons have usually adopted one of two approaches. In the first approach, conventional well logging (e.g., gamma ray, density, resistivity, and sonic) analysis techniques are utilized in conjunction with production data to infer changes in earth stresses. In the second approach, earth stresses are determined by analytic models or simulators. Either approach typically assumes steady state conditions and is specific only to a particular set of well performance conditions (e.g., single-valued average pressure, rate, temperature and single-layered formation properties).

These conventional approaches fall short of being generalized to account for multiple subterranean layers and variable, time-dependent well performance. In addition, even though displacement measurements from field surveillance may indicate the presence of multi-well interactions, conventional approaches do not scale very easily to account for these interactions at the field-level. Field surveillance methods may include surveys of ground surface displacements via tilt arrays, remote sensing (e.g., Interferometric Synthetic Aperture Radar (InSAR), Light Detection and Ranging (LiDAR), Global Positioning System (GPS)) or vertical profiling of recorded passive and/or active microseismic (μ-seismic) events. The underlying methodology of the prior art also precludes rapid forward or inverse modeling with field surveillance data to further constrain modeling problems and allow calibration of the model with collected field surveillance data.

The prior art detailing the methods of controlling subterranean injection and hydrocarbon production processes has not focused on multi-well control or the enablement of field-wide control systems. Moreover, the scope of the prior art has been limited to detecting some time-dependent, single-well characteristic of the resident or injected fluids, changes in the geometry of a hydrofracture, or a principal stress change within the very near-well regime for predicting phenomena, such as the potential for or onset of sand production.

Accordingly, what is needed is a well-based and/or a field-based, injection control process that accurately models multi-layered subterranean formations and predicts injection conditions required to improve injector performance while minimizing undesirable fracture growth and the potential for loss of fracture containment.

SUMMARY OF THE INVENTION

One embodiment of the present invention is a method for managing an impact, on an earth formation, of water injection operations associated with hydrocarbon recovery from at least one well formed in the earth formation. The method generally includes dividing the well into a plurality of layers; generating at least first and second sets of equations to model contributions to the impact of the operations due to at least first and second physical processes associated with the operations; obtaining solutions to the first and second sets of equations to determine contributions to the impact of the operations due to the first and second physical processes; combining the solutions to the first and second sets of equations to determine the impact of the operations on the earth formation; forecasting an injection mode of the water injection operations; and using earth surface displacement measurements and data gathered while monitoring the water injection operations to update the forecasted mode.

Another embodiment of the present invention provides a computer-readable medium containing a program for managing an impact, on an earth formation, of fluid injection operations associated with hydrocarbon recovery from at least one well formed in the earth formation. When executed, the program performs operations that generally include generating at least first and second sets of equations to model contributions to the impact of the operations due to at least first and second physical processes associated with the operations; obtaining solutions to the first and second sets of equations to determine contributions to the impact of the operations due to the first and second physical processes; combining the solutions to the first and second sets of equations to determine the impact of the operations on the earth formation; and adjusting the fluid injection operations at the well based on the combined solutions.

Yet another embodiment of the present invention provides a system for managing an impact, on an earth formation, of fluid injection operations associated with hydrocarbon recovery from at least one well formed in the earth formation. The system generally includes a processing unit configured to generate at least first and second sets of equations to model contributions to the impact of the operations due to at least first and second physical processes associated with the operations; obtain solutions to the first and second sets of equations to determine contributions to the impact of the operations due to the first and second physical processes; combine the solutions to the first and second sets of equations to determine the impact of the operations on the earth formation; and adjust the fluid injection operations at the well based on the combined solutions.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide a systematic, transient analysis method for determining the formation effective displacement, stress and excess pore pressure field quantities at any depth within a stratified subterranean formation resulting from the subsurface injection and/or withdrawal of pressurized fluids; a process for controlling recovery to improve well interactions while preventing excessive strain or stress-induced well deformations and mechanical failures; and a process for controlling fluid injection parameters to improve well interactions and control hydrofracture geometries.

Embodiments of the present invention also incorporate data from field surveillance, well logs, well trajectories, completions and/or various other injection or production sources for controlling various well parameters, and in self-calibrating the model. Water flood and/or water disposal operations may also be considered for some embodiments in creating or evaluating a fieldwide development strategy.

An Exemplary Earth Stress Analysis Method

The disclosed analysis method provides a logical sequence for determining said field quantities given a representative set of well logs, well trajectories, completion types and injection or production data (e.g., pressures, rates, temperatures and fluid properties). In determining said field quantities, multi-well solution methods may be derived by superposing physics-based single-well solution methods of governing processes, such as poroelastic expansion or contraction, thermoelastic expansion or contraction, and dislocations or fractures. Superposing, in such a case, may be considered as a summation of the calculations of various forces, initially considered independently, at a specified location.

Figure 1:
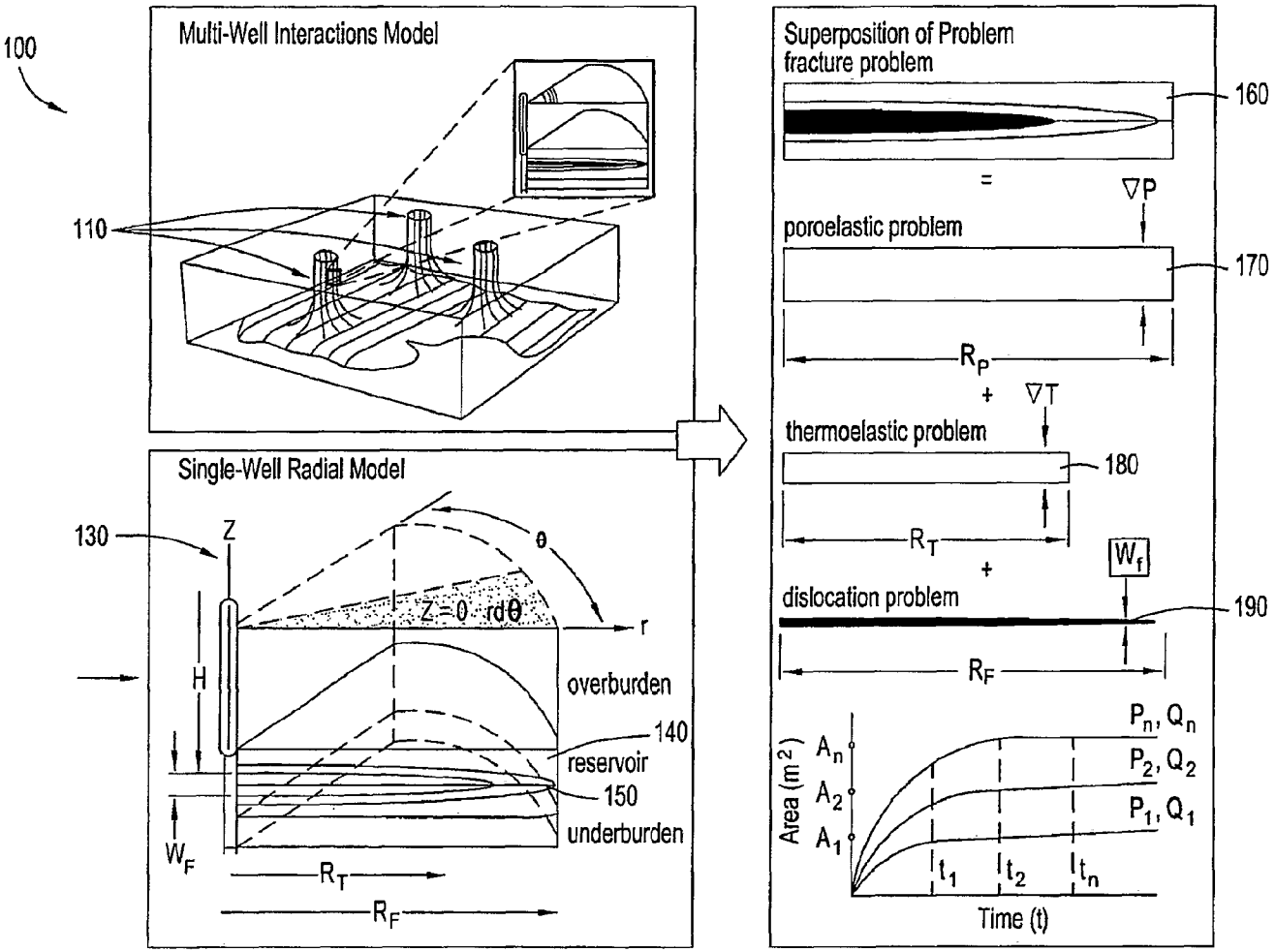
FIG. 1 illustrates a decomposition of a field-scale, multi-well problem into single-well effects in accordance with an embodiment of the present invention.

The physics-based solution method for analysis of the multi-well problem may be based on mathematical decomposition of the aforementioned governing processes on a single well basis. As an example, the case of a subsurface injection and/or production process which employs a heated fluid as an energetic injectant to aid in recovering hydrocarbons from subterranean formations may be considered. The complex recovery process may be systematically decomposed into constitutive effects in which the physics governing the effects may be well understood. As shown in FIG. 1, a full field, multi-well interactions model 100 may be decomposed into multiple single-well representations, and the single-well representations 110 may be further decomposed into some combination of various effects, such as poroelastic, thermoelastic and dislocation effects 170, 180, 190.

For the example shown in FIG. 1, the conditions may be predicated upon the assumptions of energetic injectant pressure 130 and temperature above initial subterranean reservoir conditions, axisymmetry about a single well 120 and in-situ stress conditions favoring the initiation of hydraulically-induced horizontal fractures 150, but these assumptions may not be required for general consideration in determining field quantities. In fact, the systematic earth stress analysis method may be flexible enough to account for arbitrary boundary conditions 140, in-situ stress states, injectant conditions and orientations of dislocations or fractures (if initiated). The method may also be flexible enough to account for the poroelastic 170, thermoelastic 180 and dislocation effects 190 singularly, or as a combination of said effects.

Figure 2:
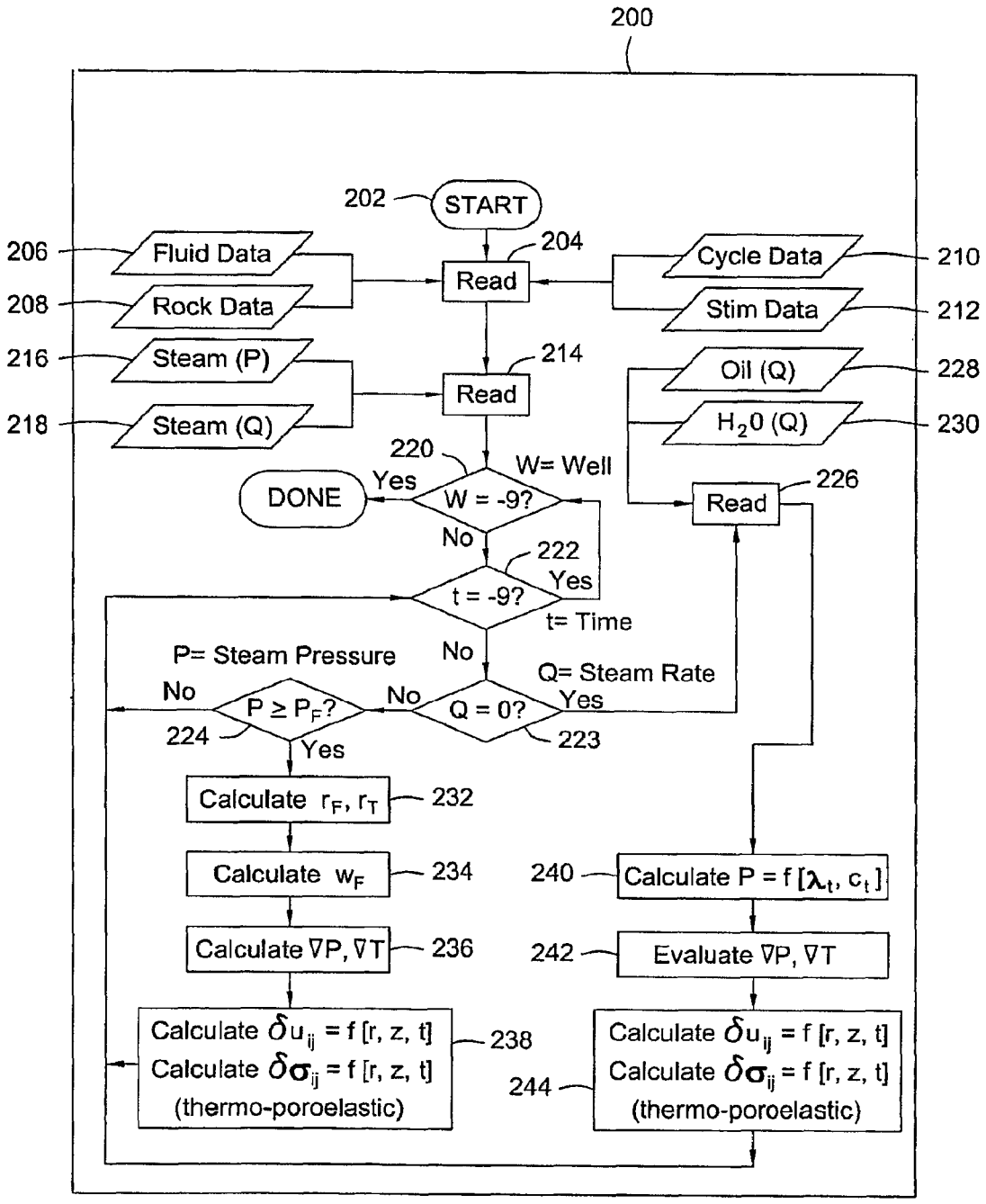
FIG. 2 is a flowchart illustrating an analysis method for determining the formation effective displacement, stress and excess pore pressure field quantities resulting from injection and/or production in accordance with an embodiment of the present invention.

For injection, the induced subterranean formation dilation and fracturing 160 may be decomposed into the equivalent effects of poroelastic expansion 170, thermoelastic expansion 180 (if the process is thermal), and opening and/or shear dislocation 190 (if fracturing occurs). For production, fracturing 160 may also be decomposed vis-à-vis injection. In either case, a systematic sequence of calculations may be made on a single-well basis for the effective components of displacement and stress as shown in FIG. 2. Data may be collected from a depth-dependent log, which may have only sparse information and only include gamma ray measurements, or the log information may include density, resistivity and sonic (monopole or dipole) measurements.

The principal assumptions that may be required for decomposition of the injection and production problems into constitutive poroelastic and thermoelastic effects may be the following: the injected and produced fluids may be incompressible, may be Newtonian and flow from point sources. With these assumptions, the injection rates may be treated as piecewise constant within the smallest time interval, but may be variable over longer intervals of time. The subterranean earth model may be composed of multiple, transversely isotropic layers and may be viewed mathematically as a propagation of layered elastic half-space solutions. The layered earth model may be prestressed with a uniform lateral compressive stress ($\sigma_o$) and an axial stress equivalent to weight ($\rho gh$) of the overlying strata.

Fractures may initiate instantaneously when injection pressure rises above a local fracture gradient and may close instantaneously when injection pressure falls below the local fracture gradient. Fracture leakoff and thermal conduction may be normal to local fracture faces, and fracture loading is symmetric without tip effects. The radial extent of pressure and thermal fronts when injecting below a local fracture gradient may be dictated by ordinary diffusion processes. The radial extent of a pressure front when injecting above a local fracture gradient may be considered equivalent to the fracture radius. The radial extent of a thermal front when injecting a heated fluid may be equivalent to the limit of advance within fractures.

Mode I opening of fractures, where the walls of the opening move perpendicularly away from the fracture plane when the fracture formed, may be equivalent to the normal displacement discontinuity. Mode II openings, or openings due to in-plane shear, may be equivalent to the shear displacement discontinuity. Shear stress at the free surface of the layered earth model may be zero. The injection-induced fracture problem may be equivalent to superposition of the poroelastic problem, the thermoelastic problem, and the dislocation problem (see FIG. 1).

FIG. 2 illustrates the general method 200 for analysis of earth stresses. The fundamental analysis may begin with the single-layered elastic half-space solution given representative input data, and systematic workflow may be established to decompose the injection or production problem into constitutive effects. The illustrated method begins at block 202, and inputs may be read at block 204. The inputs may include formation properties, such as rock data 208 (e.g., layer elastic properties, layer fracture toughness, and the like) and fluid data 206 (e.g., energetic fluid properties, fluid rate and pressure). The inputs may also include cycle data 210 and stimulation data 212. In various operations, including those involving employing a pressurized injectant, such as steam, injectant pressure 216 and injectant rate 218 may be read. The method may be designed to analyze the data collected over a specified period of time for a particular well and then proceed to analyze the data for another well, looping through the wells in turn. At block 220 it may be determined if there is a well to analyze. If there is no well to analyze or if all wells have already been analyzed, the method may stop or may proceed to block 222.

If there are more wells to analyze, the method may proceed to block 222 it may be determined if there is a time increment of data to analyze. If all the time increments of data have been analyzed, then the method may return to block 220 where the next well to be analyzed may be selected. If there is a time increment to analyze, it may be determined whether there is a flow rate at block 223. The flow rate may be the flow rate of steam. If there is a flow rate, various data, such as an oil flow rate 228 and a water flow rate 230, may be read into the system at block 226. At block 224 the pressure may be analyzed. Blocks 232 and 234 in the sequence may be performed in an effort to determine the fracture extent, fracture width and thermal extent at time t if injection is above the local fracture gradient. If fracturing and thermal effects are ignored then the pressure extent is evaluated using ordinary diffusion relationships.

For fracturing, the extent may be calculated via a convolution of a representative solution (Carter, R. D., *Derivation of the General Equation for Estimating the Extent of the Fractured Area*, Drill. & Prod. Prac., API (1957); Geertsma, J. & L. R. Kern: *Widths of Hydraulic Fractures*, J. Pet. Tech. (September 1961), Trans., AIME) for variable rate, and the convolved width may be calculated in terms of the extent accordingly. If, for example, the Carter solution is adopted as the solution for fracture extent, then the corresponding thermal extent may be determined via a convolution of the Marx- Langenheim solution (Marx, J. W. & R. H. Langenheim: *Reservoir Heating by Hot Fluid Injection*", Trans., AIME, Vol. 216 (1959)), which may be made analogous to the Carter solution. At block 236, the pressure and temperature gradients may be evaluated starting from time-dependent (preferentially real-time) pressure and temperature measurements.

If both of these measurements are not available for injection, a suitable starting point may then become the isobaric or isothermal saturation values. For production, the pressure and temperature gradients may also be evaluated starting from time-dependent (preferentially real-time) pressure and temperature measurements. If these measurements are not available for production, then the starting point may be derived from a suitable convolution for the gradients in terms of isothermal bulk compressibility and reservoir heat loss due to production.

The elastic, half-space solution (single-layered or multi-layered) for the displacement and stress field quantities may be determined as given at block 238 and may be evaluated in terms of Lipschitz-Hankel type integrals I(a,b; d) or the modified type $\tilde{J}_{mnp}$ involving Bessel functions $J_{a,b,m,n}$ given by Equation 1 as follows:

$$I(a, b; d) = \int_0^\infty e^{-q\alpha}\alpha^d J_a(\alpha R)J_b(\alpha r)\,d\alpha \tag{1}$$

$$\tilde{J}_{mnp} = \{\mathrm{sign}(\varsigma - \varsigma')\}^{(m+n+p)}\int_0^\infty J_m(t\rho)J_n(t)e^{-t|\varsigma-\varsigma'|}t^p\,dt$$

where r is the radial coordinate and R is the fracture or thermal extent; q is (z±h) and (ζ−ζ') is given by (z±h)/R, where z is the vertical coordinate and h is the burial depth, and the indices a,b; d or m,n,p are 0 to 2.

Blocks 240-244 in the sequence may be performed in parallel to the previously described blocks 232-238 (e.g., a production cycle follows an injection cycle). Otherwise only blocks 232-238 (for injection) or blocks 240-244 (for production) may be required. In either case, the solutions for injection and production may still be evaluated in terms of the Lipschitz-Hankel type integrals given by Equation 1. A rigorous mathematical formulation for displacements and stresses at any depth within the same stratified subterranean formation due to propagation of injection induced fractures below the surface may also be developed.

If a solution, such as that provided for in the previously described Carter reference, is adopted to determine rate and time-dependent fracture extent based on the input data, then a convolution is required since the solution is formulated on the basis of constant rate. The preferred convolution for the fracture extent is then given by Equation 2 as follows:

$$\pi R_F^2(t_n) = A_F(t_{n-1}) + \left[\left(\frac{Q(t_n)}{\pi\kappa\Delta P(t_n)}\right)\sqrt{(\pi D t_n)} - \left(\frac{Q(t_n)}{\pi\kappa\Delta P(t_n)}\right)\sqrt{(\pi D t_{n-1})}\right] \tag{2}$$

$$\kappa = \frac{K}{\mu},\ D = \frac{K_v}{K_h}\frac{K}{\mu\phi C_t},\ C_t = \frac{3(1-2v)}{E}$$

where $R_F$ is the half-length of injection induced thermal extent in meters, t is time in days, n is the index for time, $A_F$ is the area of injection induced fracture in square meters, Q is the injection or product ion rate in cubic meters per day, ΔP is $(P_{inj}-P_{res})$ or $(P_{prod}-P_{res})$ in pascals, $P_{inj}$ is the injection pressure in pascals, $P_{res}$ is the initial reservoir pressure in pascals, $P_{prod}$ is production pressure in pascals, K is the effective mobility to water in square meters per pascal seconds, D is the pore fluid pressure diffusivity, K is formation permeability in millidarcy, μ is the viscosity of injectant in centipoise, $K_v/K_h$ is the permeability ratio, $C_t$ is the formation bulk compressibility, ϕ is formation porosity in porosity units, E is the formation elastic modulus in pascals, and v is the formation Poisson's ratio.

Since the fracture width is assumed to be a function of the extent, the width solution is naturally rate and time-dependent. For example, the solution due to the width is given by:

$$W_F(r, t) = \frac{8(1-v^2)\sqrt{(R_F^2 - r^2)}}{\pi E}(P_{inj}(t) - \sigma_3)\left(1 - \frac{A_{pe}}{2}\right), \tag{3}$$

$$A_{pe} = \frac{\alpha_b(1-2v)}{(1-v)}$$

where $\alpha_b$ is the Biot coefficient.

The solutions to Equations 2 and 3 may be constrained according to whether there is enough pressure available within any time interval to overcome the minimum principal stress local to the point where a fracture may initiate and propagate. Therefore, it may be expected that a fracture will initiate and propagate when the criterion given by Equation 4 is satisfied such that $$P_{fp} = P_{foc} + \left[\frac{\pi E\gamma_{se}}{2R_f(1-v^2)}\right]^{\frac{1}{2}},\ P_{foc} = S_{grad} * H \tag{4}$$

$$\gamma_{se} = \frac{K_{IC}^2\pi(1-v^2)}{2E} \therefore P_{fp} = P_{foc} + \left[\frac{\pi^2 K_{IC}^2}{4R_f}\right]^{\frac{1}{2}}$$

where $P_{fp}$ is the fracture propagation in pressure in pascals, $P_{foc}$ is the opening/closing pressure in pascals, $S_{grad}$ is the maximum principal stress gradient in pascals per meter, H is the source burial depth in meters and $K_{IC}$ is the formation fracture toughness.

Analogous to the solution for rate and time-dependent fracture extent, the rate and time-dependent thermal extent may also be determined. A solution, such as that provided for in the previously described Marx-Langenheim reference, is adopted in this example and given by Equation 5, where the temperature profile ahead of the thermal front, but within the fracture, is assumed to be governed by the ordinary relationship for thermal conduction in a semi-infinite medium (i.e., Equation 6).

$$\pi R_T^2(t_n) = A_T(t_{n-1}) + \left[\left(\frac{Q(t_n)\rho h_i}{\pi k\Delta T(t_n)}\right)\sqrt{(\pi\alpha t_n)} - \left(\frac{Q(t_n)\rho h_i}{\pi k\Delta T(t_n)}\right)\sqrt{(\pi\alpha t_{n-1})}\right] \tag{5}$$

$$T_F(r \geq R_T, t) = (T_{inj} - T_{res})\mathrm{erfc}\left(\frac{r}{\sqrt{4\alpha t}}\right) + T_{res} \tag{6}$$

where $R_T$ is the half-length of injection induced thermal extent in meters, $A_T$ is the area of thermal advancement in square meters, ρ is the density of injectant in kilograms per meter, $h_i$ is the enthalpy of injectant in kilojoules per kilogram, k is the thermal conductivity in watts per meter per degrees Celsius, α is the thermal diffusivity in square meters per second, and ΔT is $(T_{inj}-T_{res})$ or $(T_{prod}-T_{res})$, where, $T_{inj}$ is the injection temperature, $T_{res}$ is the initial reservoir temperature and $T_{prod}$ is the production temperature, all in degrees Celsius.

Similarly the gradient and vertical extents of the pressure and thermal fronts, relative to fracture surfaces, may also be evaluated on the basis of a semi-infinite medium according to the following (Equations 7 and 8):

$$P(z, t) + (P_{inj} - P_{res})\mathrm{erfc}\left[\frac{z}{[4D_p t]^{\frac{1}{2}}}\right] + P_{res} \tag{7}$$

$$z_P(P, t) = 2*\left(\mathrm{erfc}^{-1}\left[\frac{(P_{res} + P_{inc}) - P_{res}}{(P_{inj} - P_{res})}\right][4D_p t]^{\frac{1}{2}}\right)$$

$$T(z, t) = (T_{inj} - T_{res})\mathrm{erfc}\left[\frac{z}{[4D_T t]^{\frac{1}{2}}}\right] + T_{res} \tag{8}$$

$$z_T(T, t) = 2*\left(\mathrm{erfc}^{-1}\left[\frac{(T_{res} + T_{inc}) - T_{res}}{(T_{inj} - T_{res})}\right][4D_T t]^{\frac{1}{2}}\right)$$

where $D_p$ is the pore fluid pressure diffusivity in square meters per second and $D_T$ is the thermal diffusivity in square meters per second.

If time-dependent temperature data for the injected and/or produced fluid conditions, sampled at reasonably repetitive intervals, is not available then it may be plausible to approximate the conditions. For example, if steam is the injectant and a constant steam quality is assumed, then the pressure changes associated with injection or production may lead to changes in temperature given by the following Equation 9:

$$\Delta T(t_n) \to f(\Delta P_{inj}(t)) = \frac{T_s}{T^*} = \left[\frac{n_{10} + D - \sqrt{(n_{10} + D)^2 - 4(n_9 + n_{10}D)}}{2}\right] \tag{9}$$

$$D = \frac{2G}{-F - \sqrt{(F^2 - 4EG)}},\ \beta = \left(\frac{P_s}{P^*}\right)^{\frac{1}{4}}$$

$$E = \beta^2 + n_3\beta + n_6,\ F = n_1\beta^2 + n_4\beta + n_7,$$

$$G = n_2\beta^2 + n_5\beta + n_8$$

where G is the formation shear modulus in pascals, β is the ratio of rock matrix to bulk compressibility ($c_{rr}/c_t$), $T_s$ is the saturation temperature in degrees Celsius, and $\eta_n$ are empirically derived values referenced by "Release on the IAPWS Industrial Formulation 1997 for the Thermodynamic Properties of Water and Steam," The International Association for the Properties of Water and Steam. Erlangen, Germany, September 1997.

The displacement field quantities ($u_r$, $u_z$) resulting from expansion or contraction of the hydrocarbon bearing reservoir may be determined by making the following assumptions: 1) occurrence of linear stress-strain relations, and 2) uniform deformation properties. Based on these assumptions, the poroelastic stress-strain relation may be given according to Equation 10 as:

$$\sigma_{ij} = 2G\left[e_{ij} + \frac{v}{1-2v}e\delta_{ij}\right] - (1-\beta)P\delta_{ij} \tag{10}$$

where $\sigma_{ij}$ is a stress component related to bulk stress system in pascals, $e_{ij}$ maybe a strain component related to bulk stress system, e is $\Sigma e_{ij}$ dilation of the bulk material and $\delta_{ij}$ is the Kronecker delta.

On the basis of thermoelastic theory, an analogy may be drawn between expansion or contraction due to pressure and temperature having similar effects on the bulk stress-strain system. This analogy may result in a thermoelastic stress-strain relationship given by Equation 11:

$$\sigma_{ij} = 2G\left[e_{ij} + \frac{v}{1-2v}e\delta_{ij}\right] - 2G\frac{1+v}{1-2v}\alpha T\delta_{ij} \tag{11}$$

For the poroelastic and thermoelastic cases, the transformations may be denoted by Equations 12 and 13:

$$c_{b_1}(1-\beta)P_{res} \Longrightarrow 3\alpha T_{res},\ c_b = \frac{3(1-2v)}{2G(1+v)} \tag{12}$$

$$c_{m,P} = \frac{(1-\beta)(1-2v)}{2G(1-v)},\ c_{m,T} = \frac{(1+v)}{(1-v)}\alpha \tag{13}$$

where $c_m$ is the uniaxial compaction coefficient.

The stress distribution $\sigma_{ij}$ should satisfy internal equilibrium conditions, and if the gravity stress field remains almost unaffected, then the equilibrium conditions should follow as $\sigma_{ij,j}=0$. In the case of steam or hot water injection, for example, the interest may lie with changes in strain and stress caused by local increases in excess pore fluid pressure above initial reservoir conditions.

The displacement field quantities ($u_r$, $u_z$) around a circular disk-shaped reservoir (e.g., the single well axisymmetric condition) may be evaluated in terms of Lipschitz-Hankel type integrals I(a,b; d) or the modified type $\hat{J}_{mnp}$ involving Bessel functions $J_{a,b,m,n}$ given by Equation 1. If the modified type $\hat{J}_{mnp}$ involving Bessel functions $J_{a,b,m,n}$ are adopted, then the displacement field quantities may be written as follows:

$$\tilde{u}_r = [\bar{J}_{110}(\rho, |\xi - \xi'|) + (3-4v)\bar{J}_{110}(\rho, \xi + \xi') - 2z\bar{J}_{111}(\rho, \xi + \xi')] \tag{14}$$

$$u_r = \tilde{u}_r\left[\frac{c_{mp,T}}{2}h(\pm\Delta P, T)\right]$$

$$\tilde{u}_z = \left[\mathrm{sgn}\frac{z-H}{R_{P,T}}\bar{J}_{100}(\rho, |\xi - \xi'|) - (3-4v)\bar{J}_{100}(\rho, \xi + \xi') - 2z\bar{J}_{101}(\rho, \xi + \xi')\right] \tag{15}$$

$$u_z = \tilde{u}_z\left[\frac{c_{mp,T}}{2}h(\pm\Delta P, T)\right]$$

where $$\bar{J}_{mnp} = \{\mathrm{sgn}(\zeta - \zeta')\}^{(m+n+p)}J_{mnp} \tag{16}$$

$$J_{110} = \frac{2}{\pi k(\rho)^{\frac{1}{2}}}\left[\left(\frac{2-k^2}{2}\right)K(k) - E(k)\right] \tag{17}$$

$$K(k) = \int_0^{\frac{\pi}{2}} \frac{d\theta}{\sqrt{1 - k^2\sin^2\theta}} \tag{18}$$

$$E(k) = \int_0^{\frac{\pi}{2}} \sqrt{1 - k^2\sin^2\theta}\ d\theta \tag{19}$$

$$J_{111} = \frac{\xi k}{2\pi(\rho)^{\frac{3}{2}}}\left[\left(\frac{2-k^2}{2k'^2}\right)E(k) - K(k)\right] \tag{20}$$

-continued $$J_{100} = -\frac{\xi k K(k)}{2\pi(\rho)^{\frac{1}{2}}} - \frac{k^2\xi^2(1-\rho)\Pi(h,k)}{4\pi\rho(1+\rho)} + 1 \text{ for } (\rho < 1) \tag{21}$$

$$= -\frac{\xi k K(k)}{2\pi} + \frac{1}{2} \text{ for } (\rho = 1)$$

$$= -\frac{\xi k K(k)}{2\pi(\rho)^{\frac{1}{2}}} + \frac{k^2\xi^2(1-\rho)\Pi(h,k)}{4\pi\rho(1+\rho)} \text{ for } (\rho > 1)$$

$$\Pi(h,k) = \int_0^{\frac{\pi}{2}} \frac{d\theta}{(1-h\sin^2\theta)\sqrt{(1-k^2\sin^2\theta)}} \tag{22}$$

$$J_{101} = \frac{k^3(1-\rho^2-\xi^2)E(k)}{8\pi(\rho)^{\frac{3}{2}}k'^2} + \frac{kK(k)}{2\pi(\rho)^{\frac{1}{2}}} \tag{23}$$

$$k^2 = \frac{4\rho}{(1+\rho)^2+\xi^2} \tag{24}$$

$$h = \frac{4\rho}{(1+\rho)^2}$$

$$k'^2 = 1 - k^2$$

For the sake of convenience, the variables ρ, ξ, and ξ' adopted beginning with Equation 14 have been normalized with respect to the pressure, thermal, or fracture radius $\mathcal{R}$ and are given by:

$$\rho = \frac{r}{\mathfrak{R}},\ \xi = \frac{z}{\mathfrak{R}},\ \xi' = \frac{H}{\mathfrak{R}} \tag{25}$$

where r is the radial coordinate of interest, z is the depth of interest and H is the source burial depth.

Once the displacement field is known from poroelastic and thermoelastic expansion or contraction effects, the stress field quantities ($\sigma_{rr}$, $\sigma_{\theta\theta}$, $\sigma_{zz}$, $\sigma_{rz}$) may be evaluated from the stress-strain relations (Equations 10-11). By assuming that the problem is radially symmetric, the following relationships outside the reservoir may be derived:

$$\sigma_{rr} = 2G\frac{\partial u_r}{\partial r} + \lambda e \tag{26}$$

$$\sigma_{zz} = 2G\frac{\partial u_z}{\partial z} + \lambda e$$

$$e = \frac{\partial u_r}{\partial r} + \frac{u_r}{r} + \frac{\partial u_z}{\partial z}$$

$$\sigma_{\theta\theta} = 2G\frac{u_r}{r} + \lambda e$$

$$\sigma_{rz} = G\left(\frac{\partial u_r}{\partial z} + \frac{\partial u_z}{\partial r}\right)$$

However, the solution may be extended to include the reservoir by adopting a piecewise linear approach to pressure or temperature gradients. That is, the reservoir thickness may be discretized into a number of infinitely thin disks and the solution may be integrated with respect to pressure or temperature within each disk. As with the displacement field, the stress field quantities may then also be written in terms of the modified type $\hat{J}_{mnp}$ Lipschitz-Hankel integrals involving Bessel functions $J_{a,b,m,n}$ as follows:

$$\tilde{\sigma}_{rr} = \left[\begin{array}{c} \bar{J}_{101}(\rho, |\xi-\xi'|) + 3\bar{J}_{101}(\rho, \xi+\xi') - 2z\bar{J}_{102}(\rho, \xi+\xi') - \\ \frac{1}{r}[\bar{J}_{110}(\rho, |\xi-\xi'|) + (3-4\nu)\bar{J}_{110}(\rho, \xi+\xi') - 2z\bar{J}_{111}(\rho, \xi+\xi')] \end{array}\right] \tag{27}$$

$$\sigma_{rr} = \tilde{\sigma}_{rr}\left[Gc_{m_{P,T}}R_{P,T}h(\pm\Delta P, T)\right]$$

$$\tilde{\sigma}_{\theta\theta} = \left[4\nu\bar{J}_{101}(\rho, \xi+\xi') + \frac{1}{r}[\bar{J}_{110}(\rho, |\xi-\xi'|) + (3-4\nu)\bar{J}_{110}(\rho, \xi+\xi') - 2z\bar{J}_{111}(\rho, \xi+\xi')]\right] \tag{28}$$

$$\sigma_{\theta\theta} = \tilde{\sigma}_{\theta\theta}\left[Gc_{m_{P,T}}R_{P,T}(\pm\Delta P, T)\right]$$

$$\tilde{\sigma}_{zz} = \lfloor -\bar{J}_{101}(\rho, |\xi-\xi'|) + \bar{J}_{101}(\rho, \xi+\xi') + 2z\bar{J}_{102}(\rho, \xi+\xi')\rfloor \tag{29}$$

$$\sigma_{zz} = \tilde{\sigma}_{zz}\left[Gc_{m_{P,T}}R_{P,T}h(\pm\Delta P, T)\right]$$

$$\tilde{\sigma}_{rz} = \left[\operatorname{sgn}\frac{z-H}{R_{P,T}}\bar{J}_{111}(\rho, |\xi-\xi'|) - \bar{J}_{111}(\rho, \xi+\xi') + z\bar{J}_{112}(\rho, \xi+\xi')\right] \tag{30}$$

$$\sigma_{rz} = \tilde{\sigma}_{rz}\left[Gc_{m_{P,T}}R_{P,T}h(\pm\Delta P, T)\right]$$

where $$J_{102} = \frac{k^3}{8\pi k'^2(\rho)^{3/2}}\left\{\left[\frac{k^4\left[1-(\rho^2+\xi^2)^2\right]}{4\rho^2k'^2} + 3\right]E(k) + \left[\frac{k^2(\rho^2+\xi^2-1)}{4\rho}\right]K(k)\right\} \tag{31}$$

$$J_{112} = \frac{k}{2\pi(\rho)^{3/2}}\left\{\frac{k^2}{4\rho k'^2}\left[\frac{k^4\xi^2}{k'^2} - 1 - \rho^2\right]E(k) + \left[1 - \frac{k^2\xi^2(2-k^2)}{8\rho k'^2}\right]K(k)\right\} \tag{32}$$

The displacement field quantities ($u_r$, $u_z$) resulting from a displacement discontinuity or dislocation disk (e.g., fracturing of the hydrocarbon bearing reservoir) may be determined by making the following assumptions: 1) the dislocation is disc-shaped and propagates at a constant distance from the free surface of an elastic half-space, 2) the dislocation is driven by a Newtonian fluid flowing from a point source, 3) the elastic half-space is pre-stressed with a uniform lateral compressive stress ($\sigma_o$) and an axial stress ($\rho gh$), and 4) there exists a non-local relationship between net pressure P (r,t) and width W (r,t) of the fracture. The non-local relationship stated in assumption 4 may be established via the superposition of dislocation disks and may be given by Equation 33 as:

$$\lfloor u_z^+ - u_z^- \rfloor = D_n \quad r < R, z = H \tag{33}$$

$$[u_r^+ - u_r^-] = \frac{r}{R} D_s \quad r < R, z = H$$

The previous equation may define the normal $D_n$ dislocation and shear $D_s$ dislocation components in terms of the fracture surface or face displacements. By adopting singular-type solutions for the dislocation disks, the singular integral equations may be represented as:

$$\int_0^R G_{nn}\left(\frac{r}{R}, \frac{s}{R}; \mathfrak{R}\right) D_n(s, t)\, ds + \int_0^R G_{ns}\left(\frac{r}{R}, \frac{s}{R}; \mathfrak{R}\right) D_s(s, t)\, ds = -\frac{R^2}{E'} p(r, t) \tag{34}$$

$$\int_0^R G_{sn}\left(\frac{r}{R}, \frac{s}{R}; \mathfrak{R}\right) D_n(s, t)\, ds + \int_0^R G_{ss}\left(\frac{r}{R}, \frac{s}{R}; \mathfrak{R}\right) D_s(s, t)\, ds = 0 \tag{35}$$

Equation 34 may imply that the normal stress across the plane of the fracture is equal to the negative of net pressure, and Equation 35 may enforce a condition of shear stress equal to zero on the fracture faces.

With the proper assumptions, as previously described, the displacement field quantities ($u_r$, $u_z$) around a circular disk-shaped reservoir (e.g., the single well axisymmetric condition) due to a prismatic or shear dislocation may be evaluated in terms of Lipschitz-Hankel modified type $\hat{J}_{mnp}$ integrals given by Equation 1:

$$\tilde{u}_r = \begin{bmatrix} -(1-2\nu)\bar{J}_{110}(\rho, |\xi-\xi'|) + \\ (\xi-\xi')\mathrm{sgn}\frac{z-H}{R_p}\bar{J}_{111}(\rho, |\xi-\xi'|) + \\ (1-2\nu)\bar{J}_{110}(\rho, \xi+\xi') - [\xi - (3-4\nu)\xi'\bar{J}_{111}(\rho, \xi+\xi')] - \\ 2\xi\xi'\bar{J}_{112}(\rho, \xi+\xi') \end{bmatrix} \tag{36}$$

$$u_r = \frac{\tilde{u}_r W_F}{4(1-\nu)}$$

$$\tilde{u}_z = \begin{bmatrix} 2(1-\nu)\bar{J}_{100}(\rho, |\xi-\xi'|) + (\xi-\xi')\mathrm{sgn}\frac{z-H}{R_p}\bar{J}_{101}(\rho, |\xi-\xi'|) - \\ 2(1-\nu)\bar{J}_{100}(\rho, \xi+\xi') - [\xi + (3-4\nu)\xi'\bar{J}_{101}(\rho, \xi+\xi')] - \\ 2\xi\xi'\bar{J}_{102}(\rho, \xi+\xi') \end{bmatrix} \tag{37}$$

$$u_z = \frac{\tilde{u}_z W_F}{4(1-\nu)}$$

If however, the injection pressure falls below the fracture opening or closing pressure, as defined by Equation 4, it may then be preferably assumed that the fracture width goes to zero instantaneously.

Beginning with the singular-type integral equations, as formulated by superposing dislocation disk singular objects, the stress field quantities ($\sigma_{rr}$, $\sigma_{zz}$, $\sigma_{rz}$) may then also be evaluated in terms of the modified type $\hat{J}_{mnp}$ Lipschitz-Hankel integrals involving Bessel functions $\hat{J}_{a,b,m,n}$. Prismatic objects may be considered for some embodiments, although shear objects may also be implemented in straightforward fashion. The radial, normal, and shear stress quantities may be stated as:

$$\tilde{\sigma}_{rr} = \begin{bmatrix} -\bar{J}_{101}(\rho, |\xi-\xi'|) + (\xi-\xi')\mathrm{sgn}\frac{z-H}{R_p}\bar{J}_{102}(\rho, |\xi-\xi'|) + \\ \frac{1}{\rho}[(1-2\nu)\bar{J}_{110}(\rho, |\xi-\xi'|)] - \frac{1}{\rho}\Big[(\xi-\xi')\mathrm{sgn}\frac{z-H}{R_p}\bar{J}_{111} \\ (\rho, |\xi-\xi'|)\Big] + J_{101}(\rho, \xi+\xi') - (\xi-3\xi')\bar{J}_{102}(\rho, \xi+\xi') - \\ 2\xi\xi'\bar{J}_{103}(\rho, \xi+\xi') - \frac{1}{\rho}[(1-2\nu)\bar{J}_{110}(\rho, \xi+\xi')] \end{bmatrix} \tag{38}$$

$$\sigma_{rr} = \frac{\tilde{\sigma}_{rr} W_f E}{4R_p(1-\nu^2)}$$

$$\tilde{\sigma}_{zz} = \begin{bmatrix} -\bar{J}_{101}(\rho, |\xi-\xi'|) - (\xi-\xi')\mathrm{sgn}\frac{z-H}{R_p}\bar{J}_{102}(\rho, |\xi-\xi'|) + \\ \bar{J}_{101}(\rho, \xi+\xi') + (\xi+\xi')\bar{J}_{102}(\rho, \xi+\xi') + \\ 2\xi\xi'\bar{J}_{103}(\rho, \xi+\xi') \end{bmatrix} \tag{39}$$

$$\sigma_{zz} = \frac{\tilde{\sigma}_{zz} W_f E}{4R_p(1-\nu^2)}$$

$$\tilde{\sigma}_{rz} = \lfloor -(\xi-\xi')\bar{J}_{112}(\rho, |\xi-\xi'|) + (\xi-\xi')\bar{J}_{112}(\rho, \xi+\xi') + 2\xi\xi'\bar{J}_{113}(\rho, \xi+\xi')\rfloor \tag{40}$$

$$\sigma_{rz} = \frac{\tilde{\sigma}_{rz} W_f E}{4R_p(1-\nu^2)}$$

where $$J_{103} = \frac{k^3}{8\pi k'^2(\rho)^{3/2}}\left\{\begin{bmatrix} \left(\frac{k^4[1-(\rho^2+\xi^2)^2]}{4\rho^2 k'^2} + 3\right)\left(\frac{k^2\xi^2[2-k^2]}{2\rho k'^2} - 1\right) + \\ \frac{k^4\xi^2}{16\rho^2 k'^2}\left(\frac{2k^2[2-k^2][1-(\rho^2+\xi^2)^2]}{\rho^2 k'^2} + 17[\rho^2+\xi^2] - 1\right) \end{bmatrix} E(k) + \\ \left[\frac{k^2}{4\rho}\left[1-\rho^2-2\xi^2\left(\frac{k^4[1-(\rho^2+\xi^2)^2]}{4\rho^2 k'^2}\right) + 3\right]\right] K(k)\right\} \tag{41}$$

$$J_{113} = \frac{k^3\xi}{16\pi(\rho)^{5/2}k'^4} \left\{\left[\frac{k^2\xi^2(2-k^2)(8k^4+3k'^2)}{4\rho k'^2} - 6(1-k^2k'^2)\right]E(k) + \left[\left[\frac{k^2}{2\rho}\right]3k'^2(1+\rho^2) - 2k^4\xi^2\right]K(k)\right\} \tag{42}$$

The single-well analysis for the effective displacement, stress, temperature and excess pore pressure field quantities may be extended to a generalized multi-well method through the principles governing superposition. The constitutive effects may first be decomposed and the net displacement and stress field quantities may be calculated. By propagating the single-layered half-space solutions via an appropriate propagation method (e.g., the Thomson-Haskell Propagator Matrix Method) and determining the n-layered solution for a single well, additional superposition of multiple single-well solutions may lead to the generalized n-well field-scale solution.

The displacement measurements from tilt arrays or remote sensing may be used to further constrain or improve the layered earth model and layer properties. Field-wide surveillance methods may include real-time surveying of earth surface and subsurface displacements via tilt arrays. Another such method may employ remote sensing capabilities (e.g., Interferometric Synthetic Aperture Radar (InSAR), Light Detection and Ranging (LiDAR), Global Positioning System (GPS)) to periodically survey earth surface displacements. For some embodiments it may be desirable to integrate field-wide surveillance methods with earth stress analysis methods as part of a calibration scheme and to enable rapid forward or inverse modeling capabilities. The displacement measurements may be used to further constrain or improve the model and/or properties on the basis of minimizing the square of the error between the measured surface displacements and the displacement field quantity predicted by the earth stress analysis method. Alternatively, a self-calibration or "teach" mode may be introduced into the method whereby the earth model layering scheme and well log derived layer properties may be iteratively varied between practical upper and lower limits until the square of the error between measured surface displacements and the calculated field displacement quantity at z=0 is reduced.

Vertical profiling of μ-seismic events may also be integrated as part of the calibration scheme. Vertical profiling of μ-seismic events may be implemented in either a forward or inverse modeling mode to further constrain calculated displacement and stress field quantities apart from surface displacement matching. In the inverse modeling scenario, information from the active or passive monitoring of events (e.g., source dimension, source magnitude, source location, and elastic strain energy release) may be used to determine the time-dependent change (e.g., damage or softening) in layer elastic properties. For the forward modeling scenario, the stress dependence of layer elastic and inelastic properties may be prescribed on the basis of experimental formation test data (i.e., from uniaxial and triaxial geomechanics testing) and information about the characteristics of synthetically generated μ-seismic events may be calculated. In some cases, additional constraints on event characterization may be introduced for the forward modeling scenario, for example, due to greater uncertainty in predicting the evolution of μ-seismicity.

Figure 3:
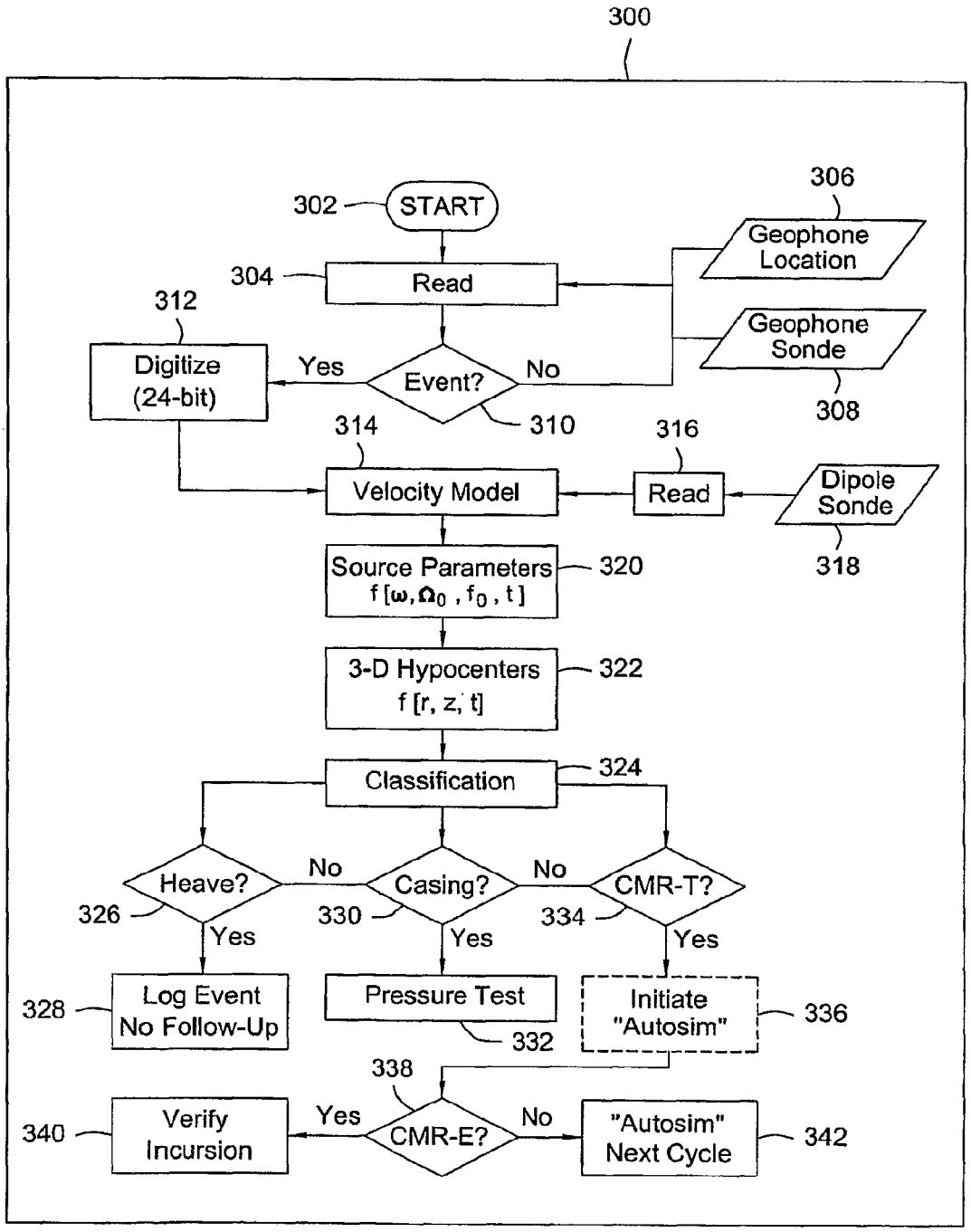
FIG. 3 is a flowchart illustrating a systematic method for passive microseismic (μ-seismic) profiling in accordance with an embodiment of the present invention.

As an example of integrating vertical profiling, FIG. 3 depicts a method 300 of vertical profiling passive or active μ-seismic events to forecast time-dependent changes in rock properties with changes in, for instance, the calculated effective temperature, excess pore pressure, displacement and stress field quantities (i.e., an active damage model). The method 300 begins at block 302, and various surveillance information may be read at block 304. The information may include electronic signals from various geophone locations 306 and various geophone sonde 308. A sonde may be any subsurface logging tool that carries electrodes, detectors, and the like into a borehole. At block 310 the occurrence of a suitable event may be determined. If no such event has occurred, data may continue to be collected and analyzed until a suitable event does occur.

If such an event has occurred, the collected data may be digitized at block 312 and incorporated into a velocity model at block 314. At block 316, information may be read from a dipole sonde 318, these waveforms may be digitized, and the digitized waveforms may also be incorporated into a velocity model. The velocity model may be used in conjunction with a suitable search algorithm to locate hypocenters 322 in a three-dimensional model. Hypocenters may be thought of as the location within the earth where an event occurs. Based on the waveform characteristics, source parameters 320, and hypocenter locations, the events may then be classified 324 as different event types (e.g., formation heave and shear, casing failure, and continuous μ-seismic radiation, which may be triggered to continuously monitor (CMR-T)).

At block 326 the question of whether the event may be classified as a heave may be determined, and if so, the event may be logged with no follow up at block 328. The various methods used for detecting and measuring earth surface displacement previously discussed may be used in determining and recording a heave event. If the event is classified such that a casing failure is indicated at block 330, then a pressure test may be conducted at block 332 to check for casing integrity. If the event is classified as continuous μ-seismic radiation at block 334, automatic and continuous monitoring (Autosim) may be initiated at block 336. If continuous monitoring positively indicates an event (CMR-E) at block 338, then Autosim may be implied on subsequent cycles represented at block 342.

Figure 4:
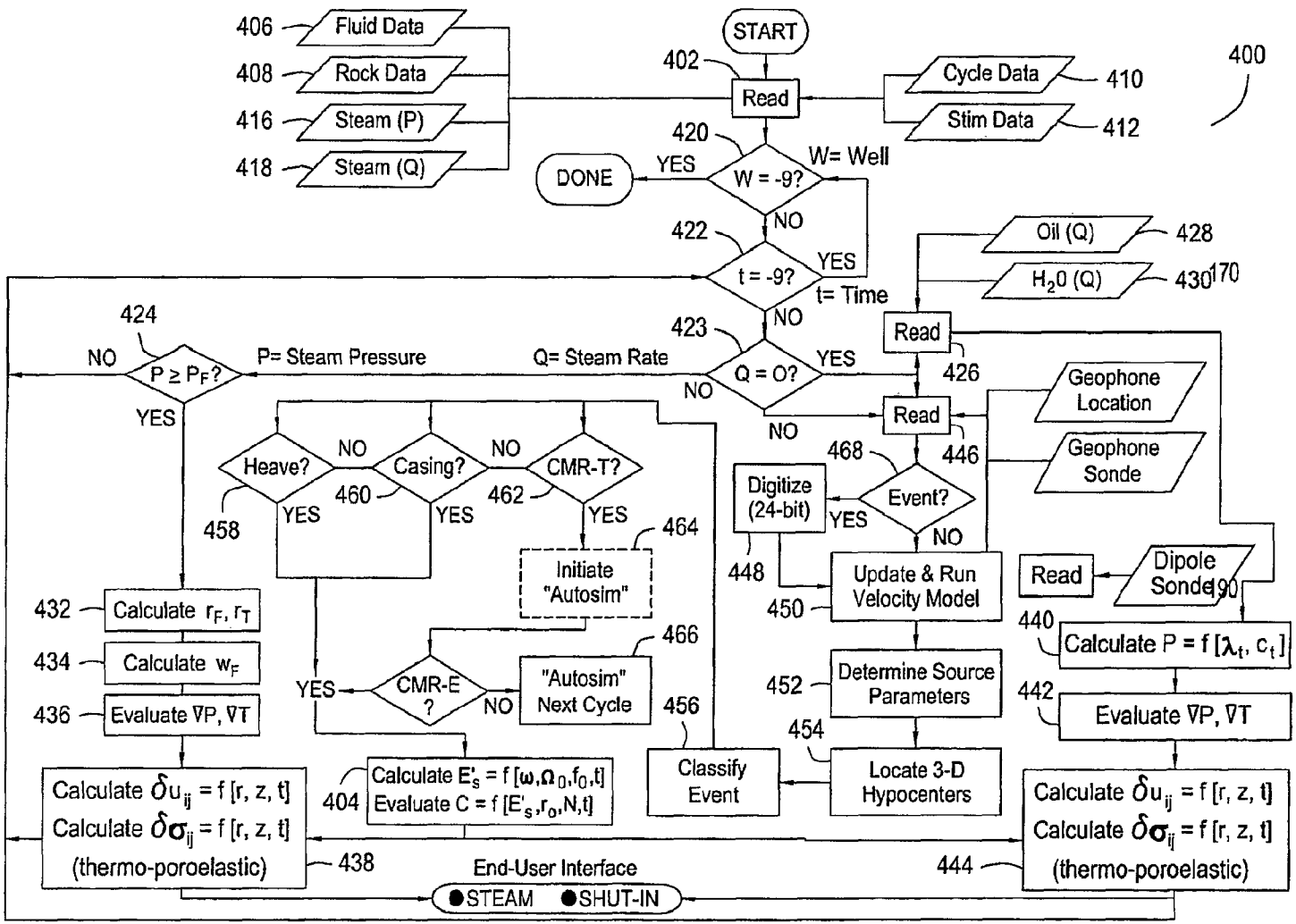
FIG. 4 is a flowchart illustrating integration of the methods in FIGS. 2 and 3 in accordance with an embodiment of the present invention.

The earth stress analysis consists of numerous variables and by applying μ-seismic data and/or fieldwide surveillance data, the analysis may be constrained. Constraining the analysis through an integration scheme may increase accuracy and responsiveness. One such viable representation of an integration scheme is shown in FIG. 4, which illustrates a method 400 that may enable correlating the predicted injection and production related field quantities (particularly the stress field quantities) at arbitrary depths with vertical profiling of time-lapse μ-seismicity. The method 400 begins by reading data regarding fluid properties 406 at block 402, rock properties 408, injectant pressure 416, injectant flow rate 418, cycle data 410, and stimulation data 412. At block 420 it may be determined whether there is a well to analyze. If there is no well to analyze or if all wells have already been analyzed, the method may stop. If, on the other hand, there are more wells to analyze, the method may proceed to block 422, where it may be determined if there is a time increment of data to analyze.

At block 423 it may be determined whether there is flow, and if the flow rate is at or around zero, then injectant pressure may be determined at block 424. If pressure exists, then fracture extent, fracture width and thermal extent may be calculated at blocks 432 and 434. The pressure and temperature gradients may then be evaluated at block 436, and the elastic, half-space solution may be determined at block 438.

If it is determined at block 423 that there is a flow rate, then oil and water flow data 428, 430 may be read at block 426, and production calculations may be performed at blocks 440-444, as described above. Whether or not there is flow, continuous monitoring for seismic events may occur at block 446. If an event is detected, it may be digitized at block 448; analyzed at blocks 450, 452, and 454; and classified at block 456.

Depending on the classification of the event (458, 460, 462), automatic and continuous monitoring (Autosim) may be initiated at block 464 and may be implied on subsequent cycles at block 466 as described herein in reference to FIG. 3. At block 404, depending on the classification of the μ-seismic event, changes in the layer mechanical properties may be optimized to match the change in energy associated with the μ-seismic events, and the in situ stress/strain state may then be evaluated or updated accordingly. In other words, the method 400 may compare the predicted result with the recorded result and iteratively adjust the parameters of the model to produce a more accurate result.

An illustrative example may be of a steam injection process. With the relevant data 406, 408, 416, 418, 410, 412, 428, 430 collected, the method 400 may determine that fracture will occur at a certain point. If an event is detected 468 and that event is determined to have been a fracture, the method 400 may then iteratively alter its calculations (i.e., self-calibrate) so that the calculated fracture point matches the actual fracture point.

Figure 5:
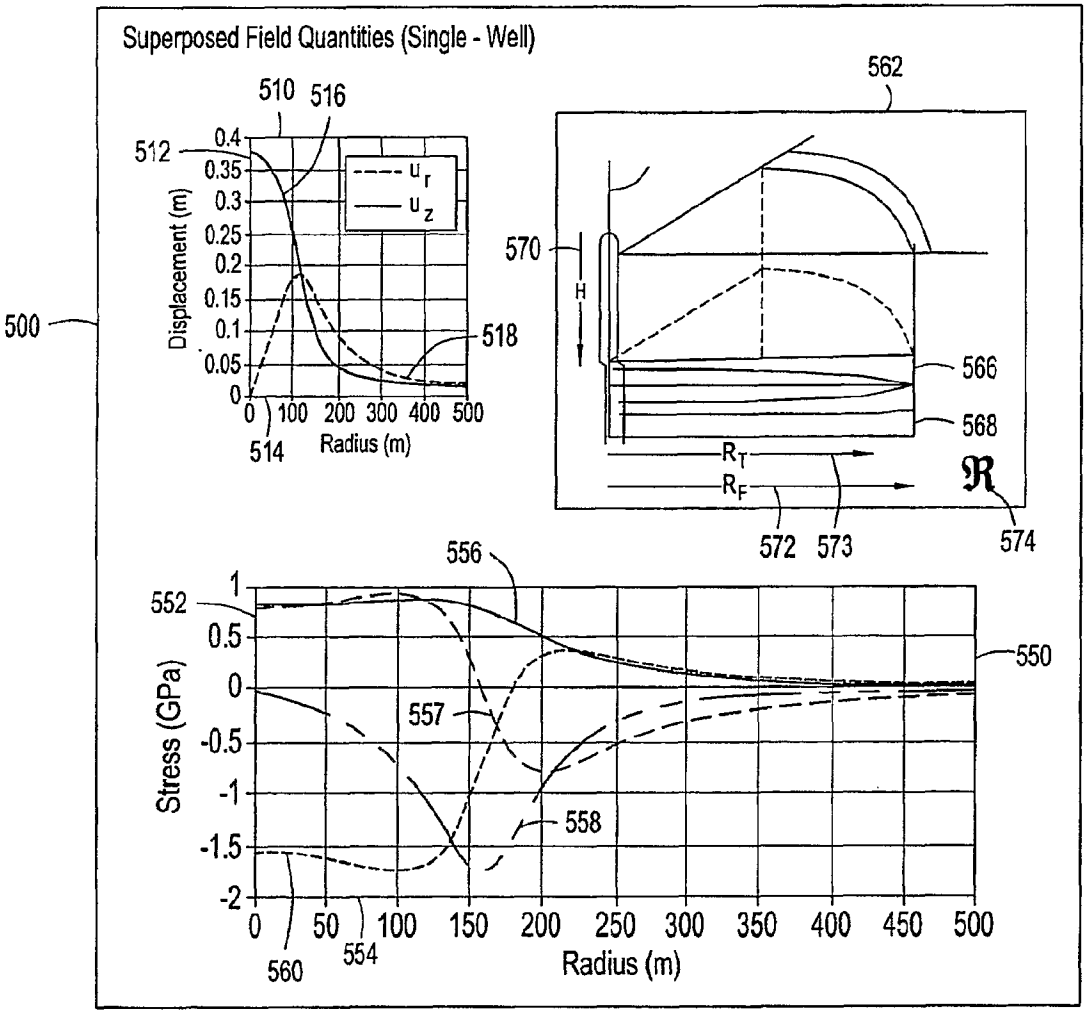
FIG. 5 depicts a superposed, single-well solution for the displacement and stress field quantities in accordance with an embodiment of the present invention.

FIG. 5 depicts a superposed single-well solution 500 for the displacement and stress field quantities due to injection-induced poroelastic, thermoelastic and dislocation effects. The displacement field quantities $u_z$ 516 and $u_r$ 518, resulting from the combination of said effects are depicted in the superposed graph 510. The vertical axis 512 represents displacement in meters, while the horizontal axis 514 represents the radius in meters. For some embodiments, single-well displacement quantities may be calculated and then may be incorporated into a larger field model.

The superposed single-well solution, as depicted in FIG. 5, permits calculation of the displacement and stress field quantities at any depth 570 within the subterranean overburden, reservoir 566 and underburden 568. This is accomplished by assuming the problem of axisymmetry 562 about a single well 564 and in-situ stress conditions favoring the initiation of hydraulically induced horizontal fractures having a plurality of radii 574, comprising a radius of dislocation 572, radius of poroelastic expansion or contraction 572 and radius of thermoelastic expansion or contraction 573. Although adopted herein, these assumptions may not necessarily be required for general consideration in determining the absolute displacement and stress field quantities. For some embodiments, single-well displacement quantities may be calculated and then may be incorporated into a larger field model.

A field model may consist of data that may be related to a plurality of single wells. Individual well performance and local displacements may be influenced by various factors, such as stresses, acting upon the formation due to other wells operating in the same formation. Through superposition, the analysis of individual wells may be combined to more accurately model stresses within the formation, the field and the conditions at individual wells. Field models may predict field displacements and, if actual field displacement is measured, then the model may be checked for accuracy and adjusted so that it better predicts the results of the actual event.

Graph 550 graphs superposed stress 552 on a well in GPa versus radius 554 in meters, according to the earth stress analysis techniques described herein. $S_{tt}$ 556 represents tangential stress, $S_{rr}$ 557 represents radial stress, $S_{rz}$ 558 represents shear stress and $S_{zz}$ 560 represents vertical stress for an example well. For some embodiments the calculation of various stresses may allow increased productivity, while potentially avoiding situations in which stress limits may be exceeded. If stress limits are exceeded, damage to valuable equipment may occur along with costly delays.

An Exemplary Hydrocarbon Recovery Control Process

It may also be desirable to control hydrocarbon recovery at a "field level" to improve multi-well interactions while preventing excessive stress or strain-induced well deformations and mechanical failures. A field-level control process or system may be a variant (either linearized or nonlinear) of the model predictive control (MPC) process, whereby the future behavior of dependent variables (e.g., well operating conditions) of the dynamic system (well or field-based) may be predicted according to past variations or changes in the independent system variables (e.g., subterranean layering, layer elastic properties, present well operating conditions, multi-well injection or production schemes). An advantage of such a process may be that direct or indirect operating control feedback, on a per-well basis, may be relied on much less since the dynamic effects of input variations on well mechanical integrity will be mostly known a priori.

Figure 6:
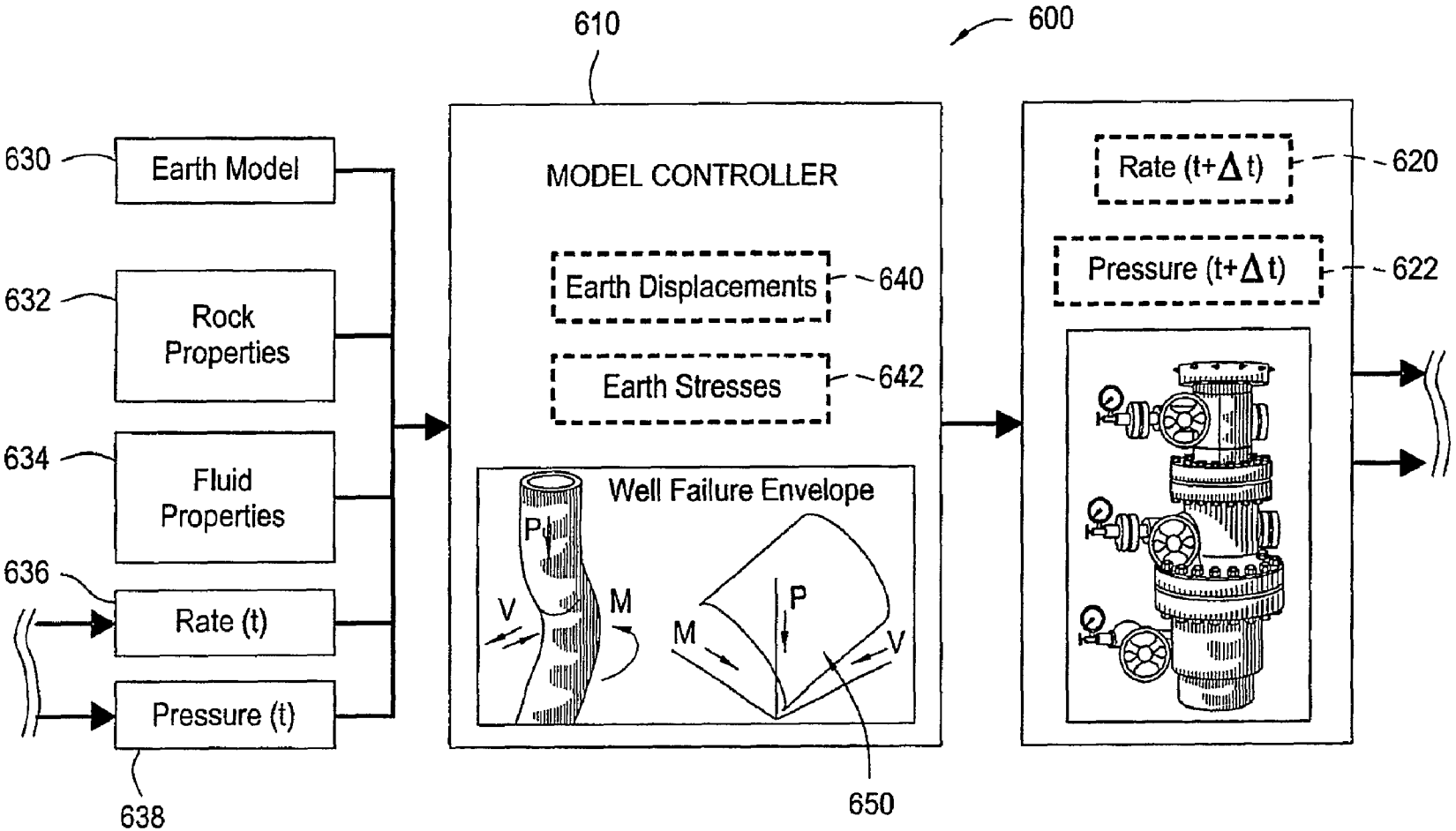
FIG. 6 illustrates a model predictive control (MPC) scheme to forecast well operating conditions relative to well mechanical integrity in accordance with an embodiment of the present invention.

In FIG. 6, an MPC scheme 600 for forecasting well operating conditions is depicted. A model predictive controller 610 may be employed to forecast well operating conditions (e.g., rate 620 and/or pressure 622) based on the present risk of compromising well mechanical integrity. Inputs to the model predictive controller 610 may include the layered earth model 630 of subterranean lithology, properties of the rock 632 within the layer (e.g., elastic properties), energetic fluid properties 634, and present fluid rate at time t 636 and/or pressure at time t 638. The outputs may be the forecasted fluid rate (at time t+Δt) 620 and/or a forecasted pressure (at time t+Δt) 622.

Using at least some of these inputs, the model predictive controller 610 may uniquely calculate earth displacements 640 and stresses 642 along selected well profiles and may instantaneously evaluate where the current state of stress lies in relation to a well failure envelope. If the current stress state lies inside the failure envelope 650, a maximum gain in output may be predicted iteratively in an effort to minimize error between failure and current stress. Injection and/or production rates may be adjusted based on calculations performed regarding the current stress state's position inside the failure envelope. These adjustments have the potential to increase productivity while reducing the chance of costly failures.

If the current stress state falls outside the envelope, the output may be triggered to a "wait" or "off" state. A wait state may be maintained until the current stress states returns to a safe position inside the failure envelope. However, another scenario may be when the controller predicts the intersection of the well failure envelope and generates an alternate scenario stress-strain prediction (ASP) on-line to avoid intersecting the well failure envelope and triggering a "wait" state. An alert may also be given; allowing an opportunity for an operator to adjust production parameters manually. The ASP should include appropriate constraints on inputs (e.g., bounds for well operating conditions including number of active wells, subterranean layer elastic properties, number of layers in the earth model representation).

Figure 7:
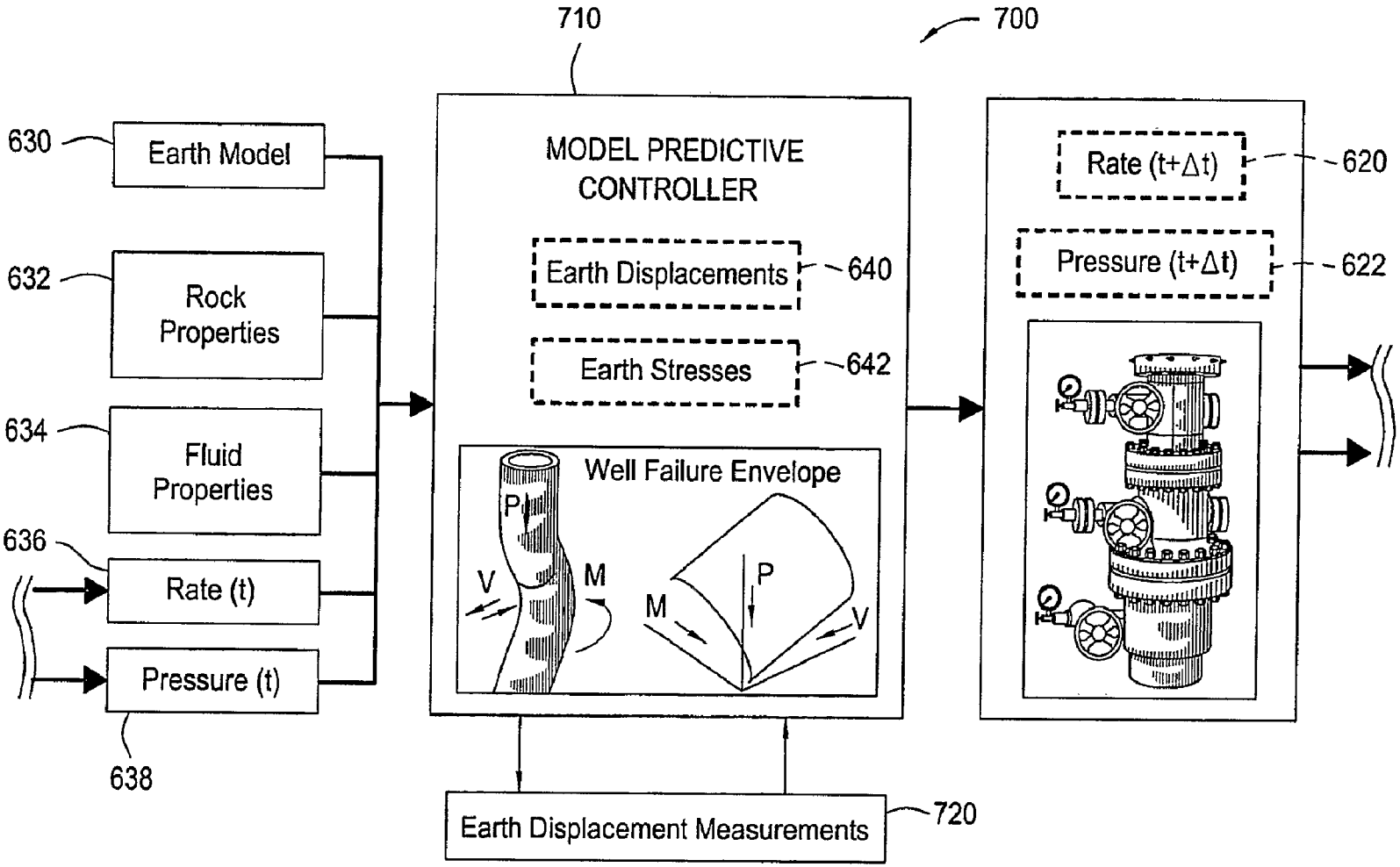
FIG. 7 illustrates an MPC scheme that incorporates earth displacement measurements in accordance with an embodiment of the present invention.

In FIG. 7, a model predictive control scheme 700 that may utilize earth displacement measurements to self-calibrate is depicted. A model predictive controller 710 may utilize tilt array or remote sensing measurements (e.g., Interferometric Synthetic Aperture Radar (InSAR), Light Detection and Ranging (LiDAR), Global Positioning System (GPS)) of earth surface displacements 720 in real-time to further constrain the model and self-calibrate ("teach") prior to forecasting fluid rate (at time t+Δt) 620 and/or forecasting pressure (at time t+Δt) 622. As an example, if the model-based calculations for earth displacements 640 at ground surface match the measured surface earth displacements, the MPG may continue to forecast. Otherwise, rock property inputs 632 and the earth model layer scheme 630 may be varied autonomously within the spread of reported and/or experimental values ("input constraint") until a reduced error is achieved between the calculated and measured displacements. Once a desired minimum error is reached, the model predictive controller 710 may proceed with evaluating the output on the basis of comparing ASPs for the possible permutations of constrained layer elastic properties (e.g., log-based and/or geomechanics test-based) and layering schemes (e.g., log-based and/or core-based) given current well operating conditions.

Figure 8:
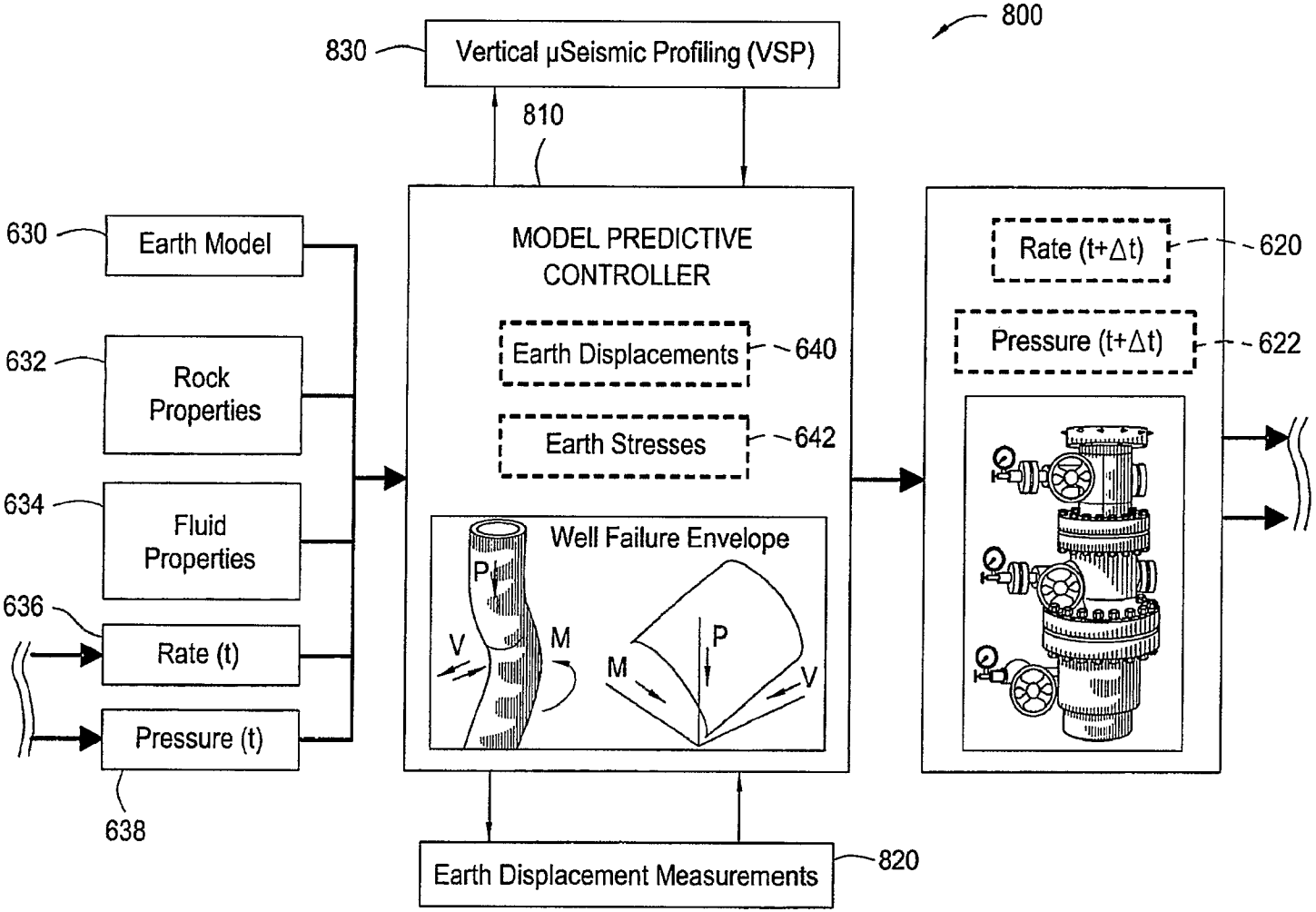
FIG. 8 illustrates an MPC scheme that simultaneously incorporates earth displacement measurements and vertical profiling of μ-seismic events in accordance with an embodiment of the present invention.

In FIG. 8, a model predictive control scheme 800 that may utilize earth displacement measurements and vertical profiling of microseismic (μ-seismic) events is depicted. The model predictive controller 810 may utilize measurements of both earth displacements 820 and vertical μ-seismic profiling 830 simultaneously prior to forecasting well operating conditions (at time t+Δt). Within the MPG scheme 800, vertical μ-seismic event profiling 830 may be implemented in either a forward or inverse mode in an effort to further constrain forecasting displacement (or strain) and stress calculations aside from surface displacement matching. In an inverse modeling mode, information from the active or passive monitoring of events (e.g., source dimension, source magnitude, source location, elastic strain energy release) may be used to predict the time-dependent change (e.g., damage or softening) in layer elastic properties (rock property inputs 632).

In a forward modeling mode, the stress dependence of layer elastic and inelastic properties may be prescribed on the basis of experimental formation test data (e.g., from uniaxial and triaxial geomechanics testing), and information about the characteristics of synthetically generated μ-seismic events may be predicted. Additional constraints on event characterization may be required for the forward modeling scenario because of greater uncertainty in predicting the evolution of μ-seismicity.

Well mechanical integrity may be managed by a well-located MPC system. One element of a well-located MPC system may be a physics-based control "engine" for transient analysis of formation effective displacement, stress and excess pore pressure field quantities. A strain or stress based systematic method for analysis of the multi-well problem through decomposition of phenomena governing single-well mechanical response, as described above, may be used in an MPC system.

An Exemplary Computer-Based Model Predictive Control Scheme

Figure 9:
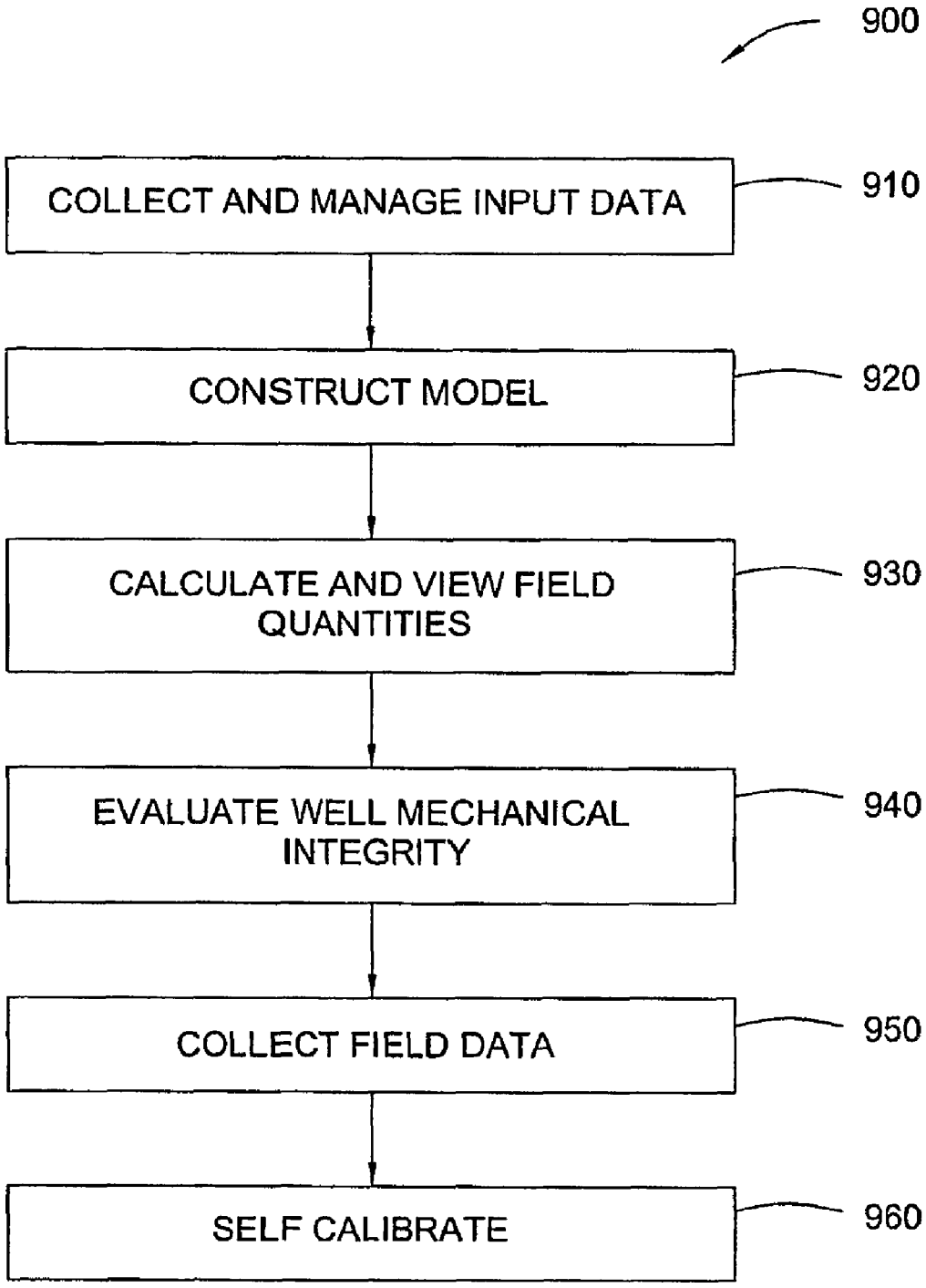
FIG. 9 illustrates a flow chart of a computer-based MPC scheme for in accordance with an embodiment of the present invention.

In FIG. 9, a computer-based implementation 900, using an interactive graphical computer software code may be designed to be flexible and interpretive in its use. The code may consist of a graphical user interface (GUI) comprising a variety of modules. As an example, the modules may be used interactively to manage data inputs at block 910, construct the layered earth model and layer elastic properties at block 920, calculate and view field quantities at block 930, evaluate well mechanical integrity at block 940, collect field data at block 950 and self-calibrate at block 960. However, other computer-based instantiations of the MPC scheme may be implemented. Accordingly, the following description of the example GUI is intended not to be considered as limiting, but to be illustrative as an example implementation of the predictive control system or process.

Figure 10:
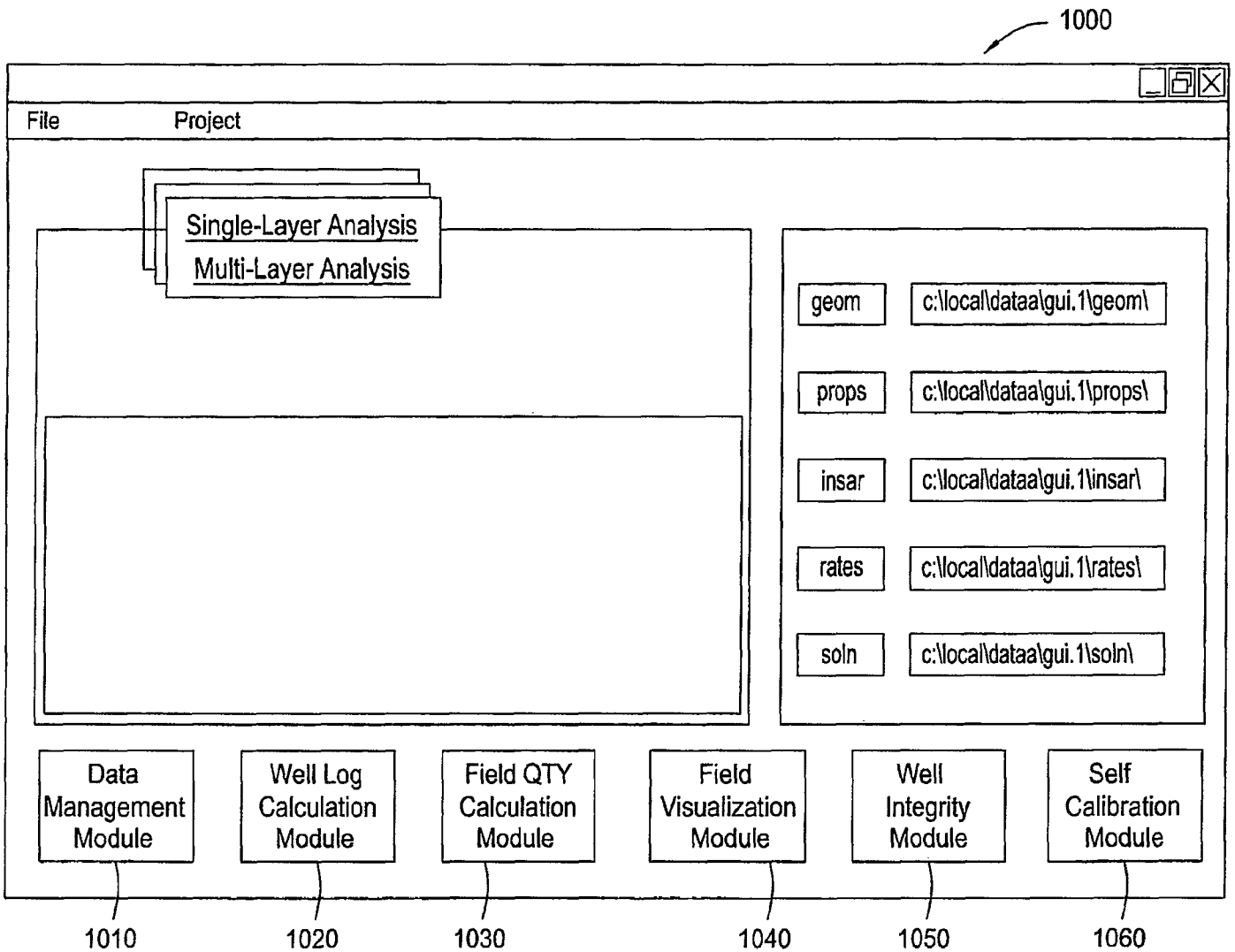
FIG. 10 illustrates a main graphical user interface (GUI) for characterization and control of earth stresses associated with a hydrocarbon recovery process in accordance with an embodiment of the present invention.

In FIG. 10, an exemplary main GUI 1000 may enable functionality for defining a project, the type of analysis (i.e., a single-layer or multi-layer analysis) and the paths for solution data retrieval and storage. The main GUI may also enable various exemplary modules as follows: a data management module 1010, a well log calculation module 1020, a field quantity calculation module 1030, a field visualization module 1040, a well integrity module 1050 and an MPC self-calibration module 1060. Below is a brief description of the basic functionality of these modules.

Figure 11:
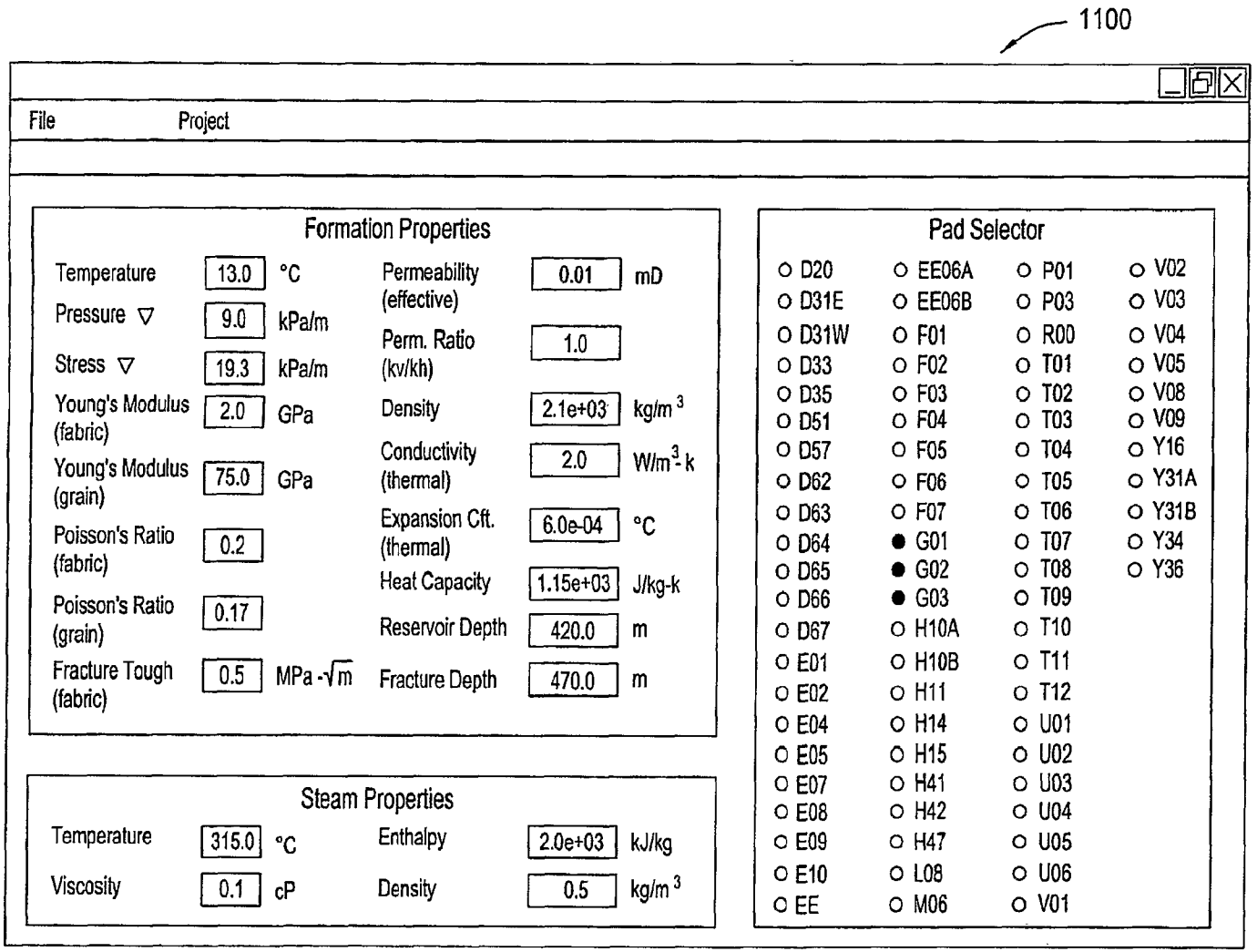
FIG. 11 illustrates a data management module in the main GUI of FIG. 10 in accordance with an embodiment of the present invention.
Figure 12:
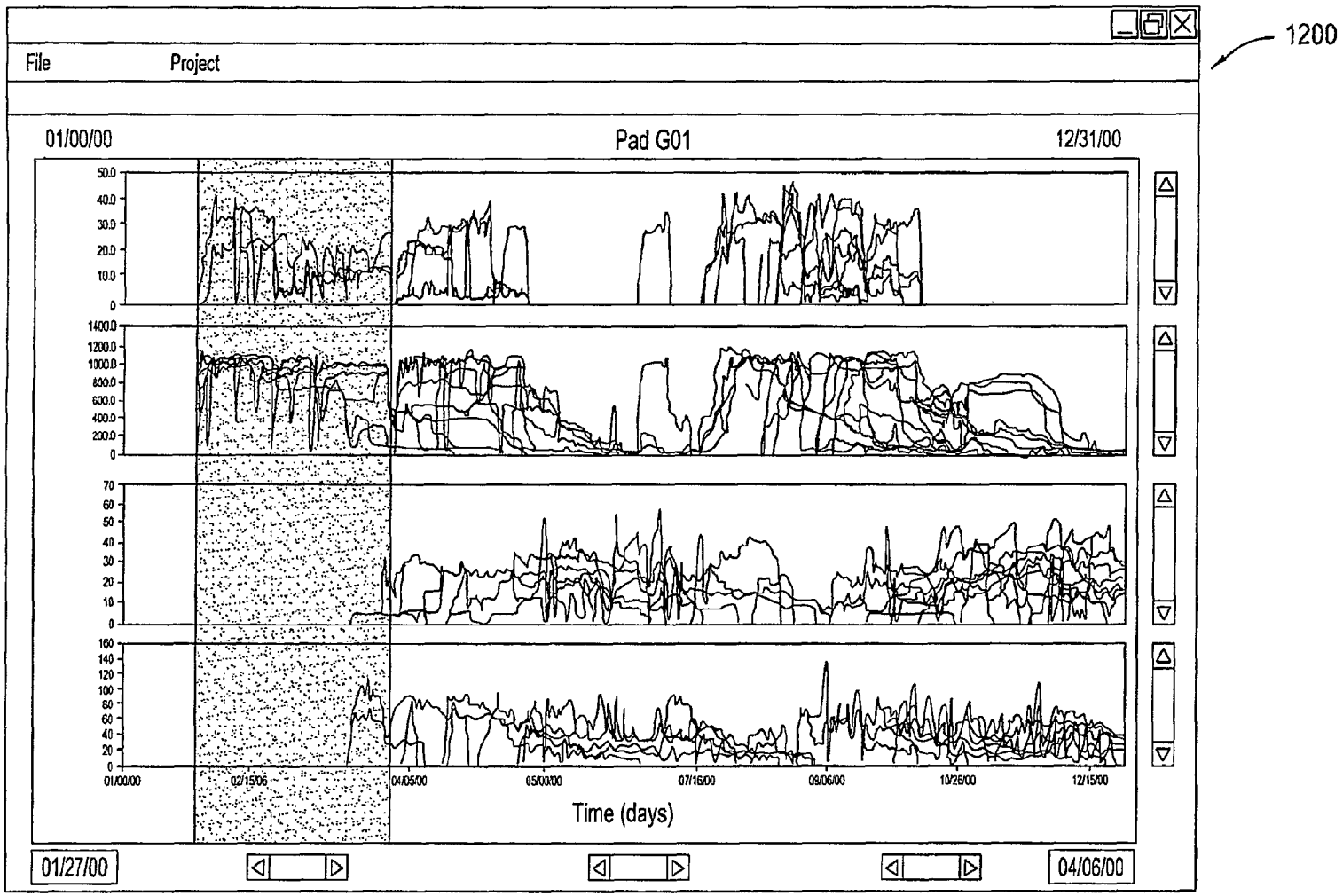
FIG. 12 illustrates an execution form of a data management module in the main GUI of FIG. 10 in accordance with an embodiment of the present invention.

FIG. 11 illustrates an exemplary data management module 1100 that may define the type of operational process to evaluate and the associated input formation and injectant properties. An example may be a steam-based thermal recovery process where steam may be injected in a multi-well row-by-row scenario (i.e., a pad configuration), hence steam properties and multi-pad selection may be permitted. FIG. 12 depicts a data management module 1200 according to another embodiment of the invention that may permit the user to graphically select the time frame and associated well operating parameters over which a calculation of field quantities is to occur. In a control mode, the time frame may be synchronized with the frequency at which the well operating parameters may be sampled.

Figure 13:
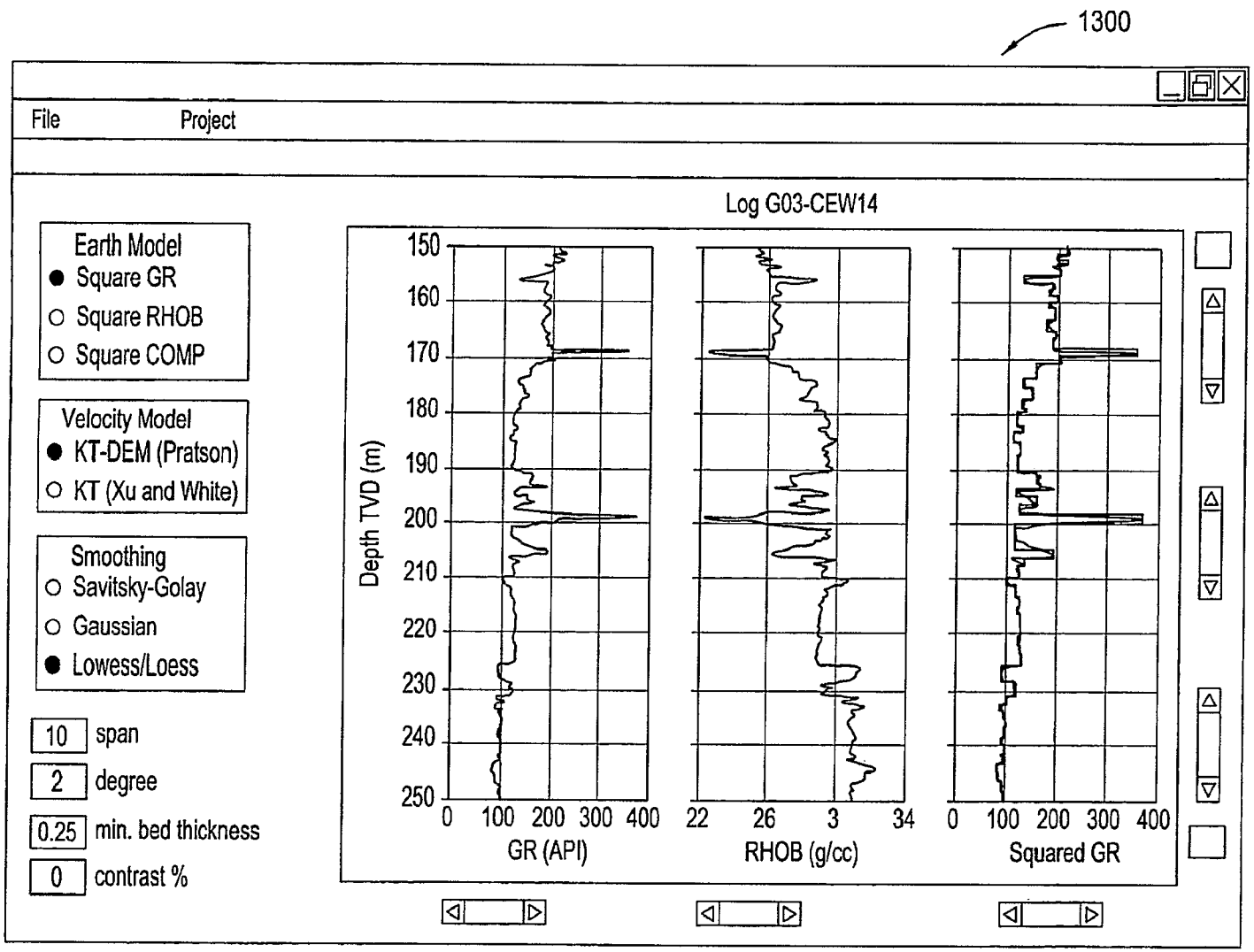
FIG. 13 illustrates a well log calculation module in the main GUI of FIG. 10 in accordance with an embodiment of the present invention.

As depicted in FIG. 13, an exemplary well log calculation module 1300, may be enabled when the analysis type is a multi-layered analysis. This module may permit the user to load log files from representative wells for use in evaluating the layered earth model and layer elastic properties. In this example, the stratified earth model is defined from the gamma ray log, although multiple logs or composites from multiple logs (e.g., bulk density, resistivity and sonic) may be used in defining the earth model. Once the earth model has been stratified via a convolution of the logs, then layer properties may be calculated using analytical relationships or empirical correlations known to those skilled in the art.

Figure 14:
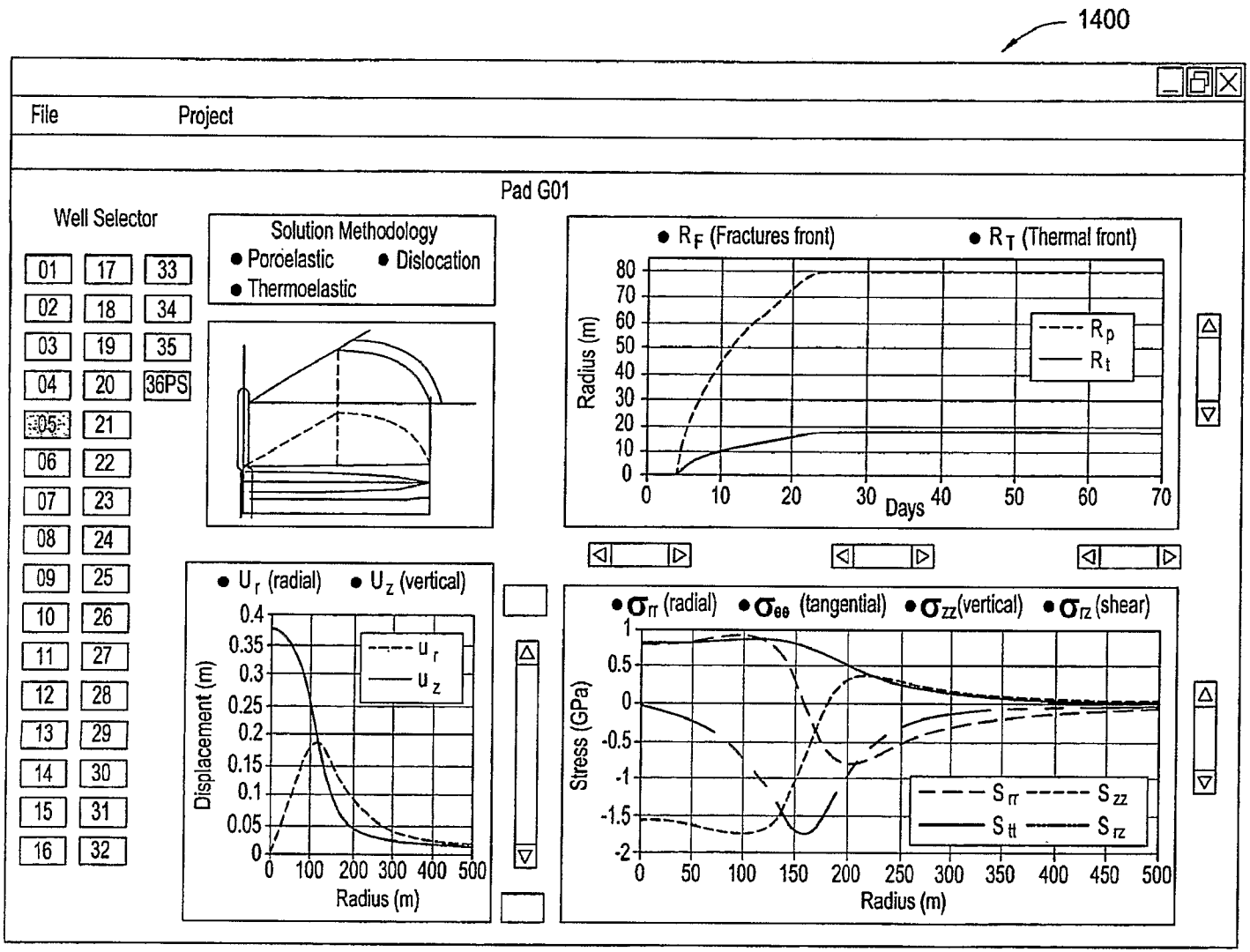
FIG. 14 illustrates a field quantity calculation module in the main GUI of FIG. 10 in accordance with an embodiment of the present invention.
Figure 15:
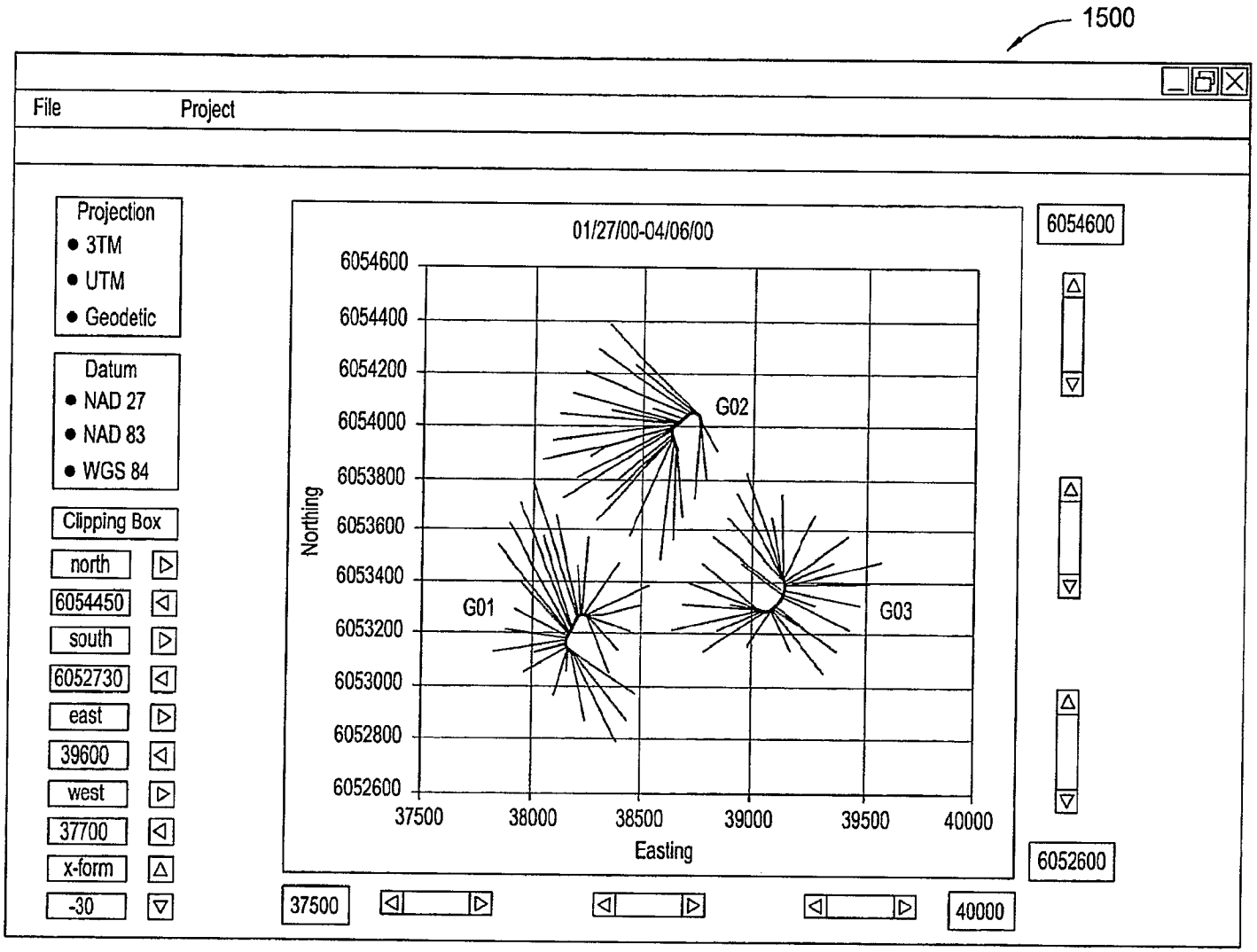
FIG. 15 illustrates an execution form of a field quantity calculation module in the main GUI of FIG. 10 in accordance with an embodiment of the present invention.

Once the earth model and associated layer properties have been determined, a transient analysis of field quantities based on constitutive effects and input data may be calculated. FIG. 14 is an exemplary depiction of the field quantity calculation module 1400, which may permit interrogation of the single-well solution (either poroelastic, thermoelastic, dislocation or some combination thereof) for any particular well. This module may display the transient results for the fracture and thermal fronts, and displacement and stress components at any arbitrary subterranean depth. FIG. 15 depicts another exemplary form of the field quantity calculation module 1500, which may allow the user to graphically define the areal extent over which the single-well solutions may be superposed to solve for the field quantities. This form may be flexible enough to compensate for various projection standards (e.g., State Plane Coordinate System (SPCS), 3-degree Transverse Mercator (3TM), the Universal Transverse Mercator (UTM), and the Geodetic Reference System (GRS90)) and datum references (e.g., North American Datum 1927 (NAD 27), North American Datum 83 (NAD 83), and World Geodetic System 1984 (WGS 84)), and this form may also permit coordinate transformations.

Figure 16:
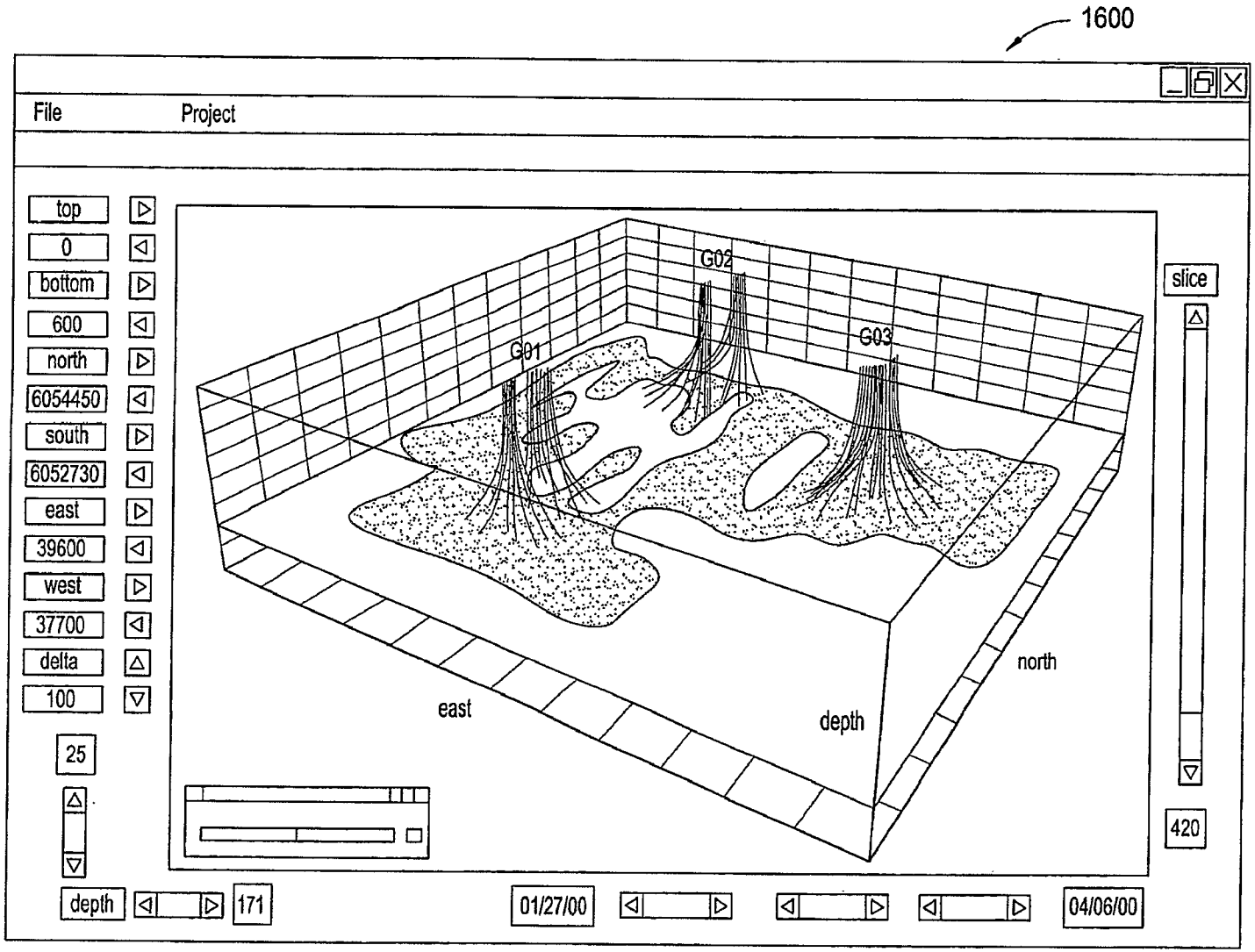
FIG. 16 illustrates a field view module in the main GUI of FIG. 10 in accordance with an embodiment of the present invention.

FIG. 16 depicts a field visualization module 1600 that may enable the user to visualize the spatial variation of field quantities (e.g., excess pore pressure, displacement, and strain or stress via a "Setup" menu) as a function of subterranean depth. This module may also enable the user with a capability to simultaneously rotate or scale the 3-D field display in any orientation, and it may also be capable of interrogating (querying) the superposed solution at some selected point or coordinate in space for the interpolated result. Since the full-field solution should now be known, the user may be able to evaluate well mechanical integrity on a "per well" basis.

Figure 17:
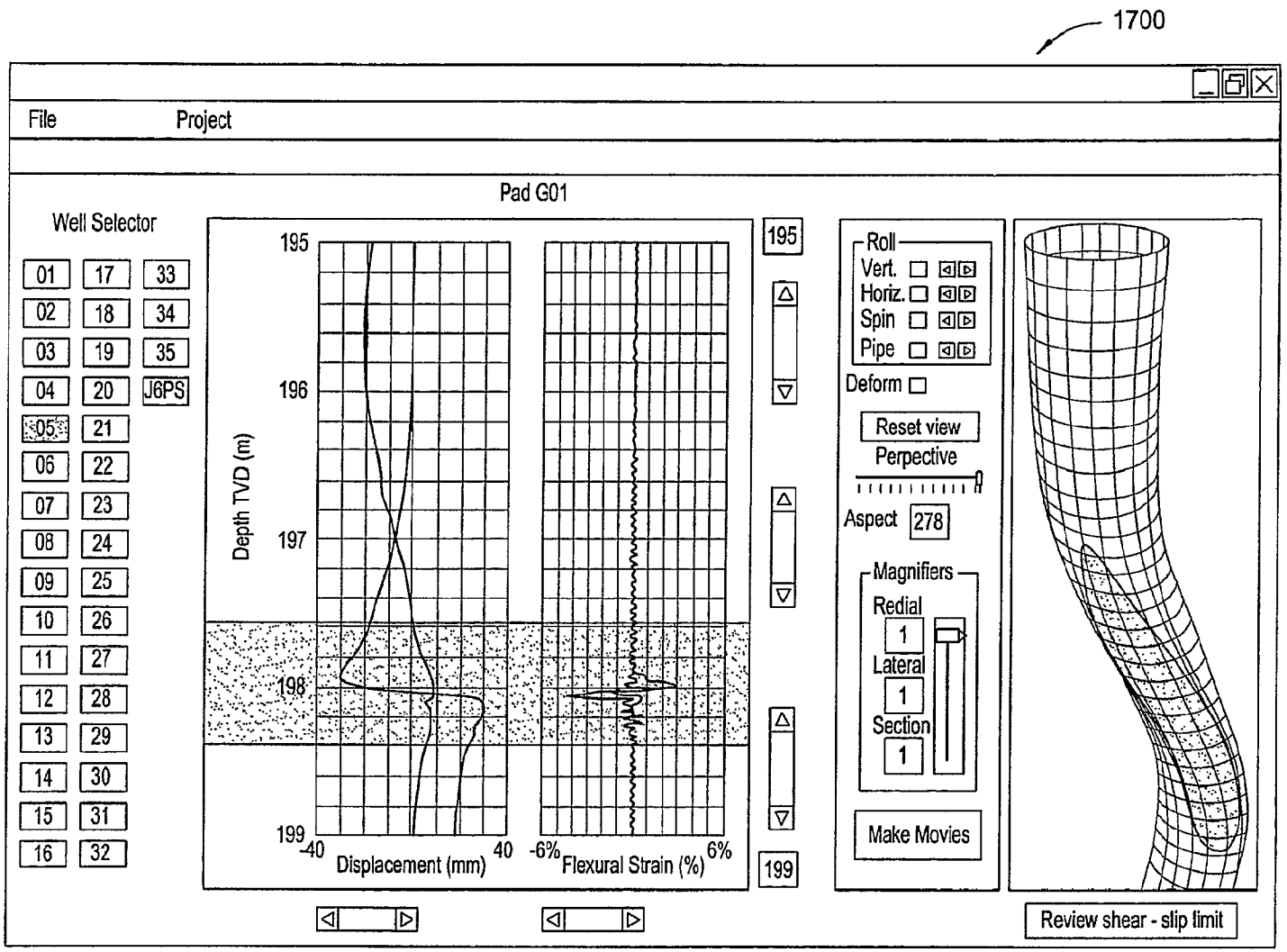
FIG. 17 illustrates a well integrity module in the main GUI of FIG. 10 in accordance with an embodiment of the present invention.

FIG. 17 depicts a well integrity module 1700 that may be employed for querying particular components of displacement, strain or stress along individual well profiles, which may comprise the geometric description (geometry data file) in conjunction with well completion details (e.g., completion type, cement type, casing grade and weight). Like the field visualization module 1600, the well integrity module 1700 may have similar 3-D display capabilities, but permit the user to interpret depth-dependent well deformation and strain components (e.g., flexural strains) either directly inferred or calculated.

Figure 18:
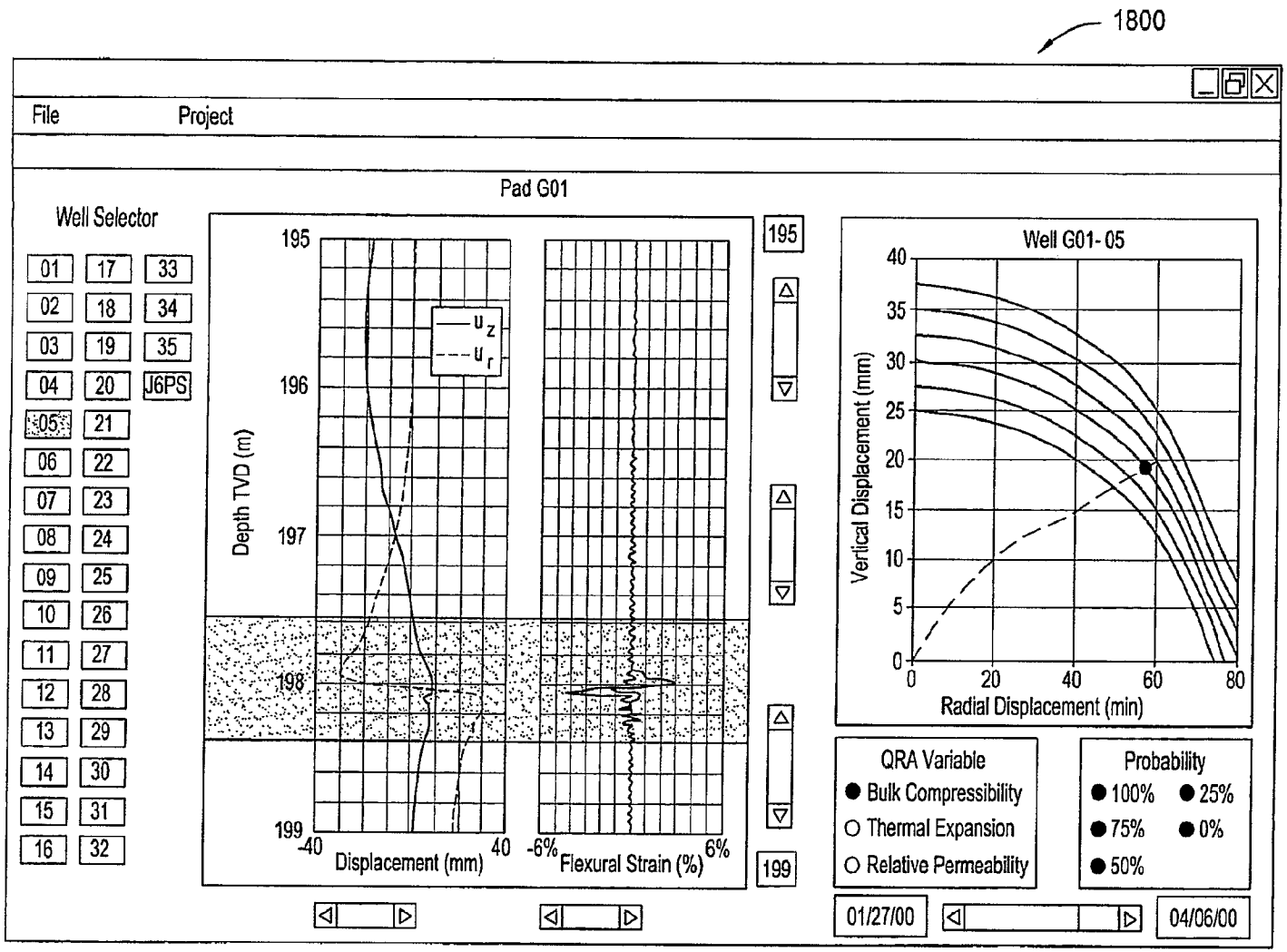
FIG. 18 illustrates a shear-slip limit approach used in a well integrity module in the main GUI of FIG. 10 in accordance with an embodiment of the present invention.

The well integrity module 1700 may also have on-line warning or alarm functionality whereby the user is notified in the event that a single or multiple wells have met certain mechanical integrity criteria (e.g., the buckling limit or the shear-slip limit). FIG. 18 depicts an adoption 1800 of a shear-slip limit approach as a constraint on integrity for the example depicted in FIG. 17. That is, if a certain magnitude and "interaction" of the radial and vertical component of displacement is detected along any well profile, then a warning and/or alarm state should be displayed to the user. In control mode, this state could lead to a change in the control state (e.g., a gain reduction) for the injection or production rates. In an MPC-based configuration, the aforementioned concept may easily be envisioned to adopt quantitative risk analysis measures for constraints on prediction of alternate injection or production operating scenarios.

Figure 19:
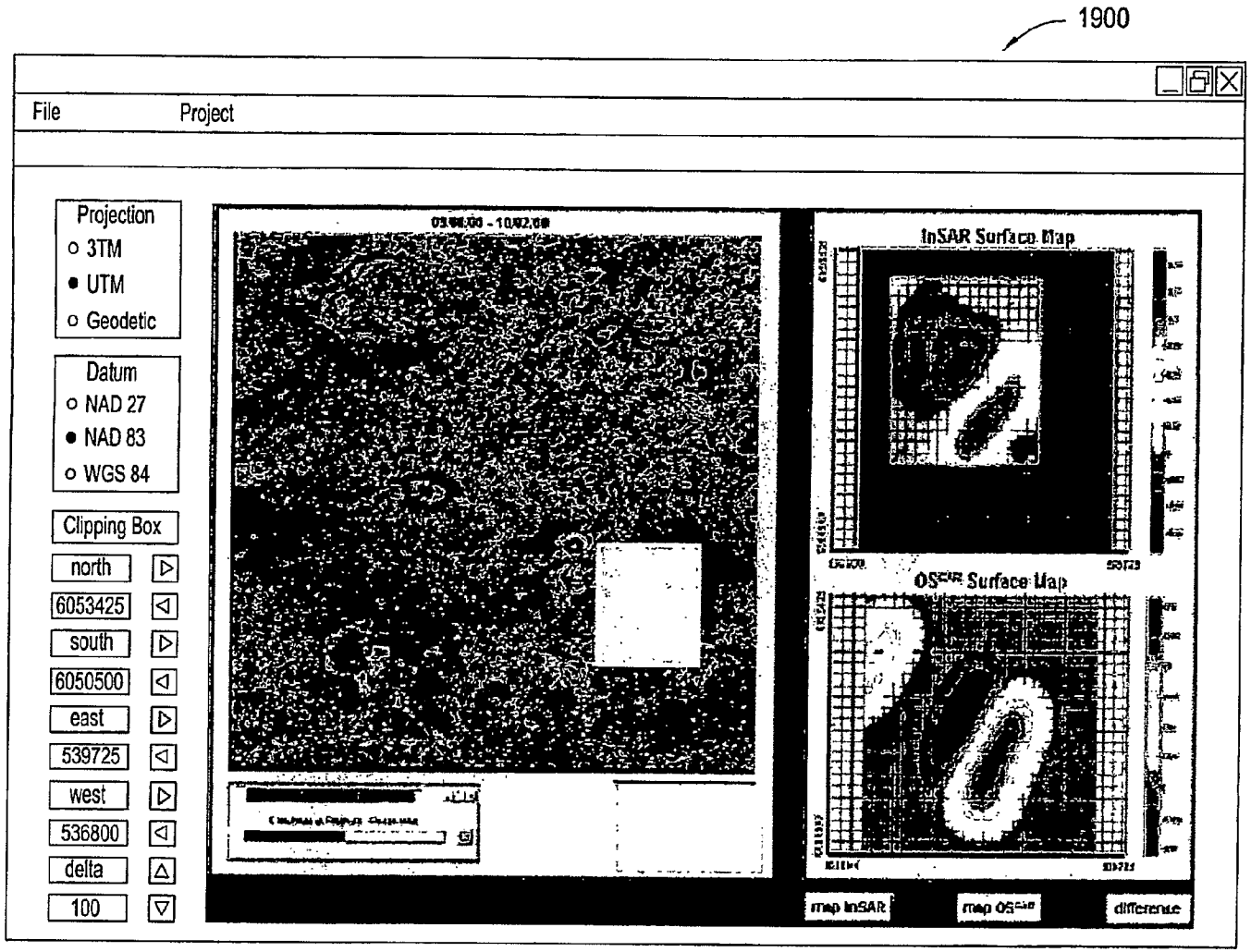
FIG. 19 illustrates an MPC self-calibration module in the main GUI of FIG. 10 in accordance with an embodiment of the present invention.

FIG. 19 depicts an implementation of a model predictive control (MPC) self-calibration module 1900, which may enable the functionality for processing remote sensing measurements (e.g., Interferometric Synthetic Aperture Radar (InSAR), Light Detection and Ranging (LiDAR), and Global Positioning System (GPS)). As an example, the module may provide the capability to create interferograms from 2-pass, single-look complex (SLC) synthetic aperture radar (SAR) images. From the interferograms of the two SLC SAR images, time-dependent vertical surface displacements of the ground surface may be employed in an MPC-based control configuration for predictive model self-calibration. Measured surface displacements and, consequently, surface strains or stresses may also be compared with the stress inversion of microseismic events for auto-correction of predicted spatial distribution of stress.

An Exemplary Fluid Injection Process

A variant (either linearized or nonlinear) of the model predictive control (MPC) process may also be used for controlling fluid injection parameters in an effort to improve well interactions and control hydrofracture geometries. For example, the future behavior of dependent variables (e.g., well operating conditions) of the well or field-based dynamic system may be predicted according to the past variations or changes in the independent system variables (e.g., subterranean layering, layer elastic properties, present well operating conditions, multi-well injection or production schemes). An advantage of this process may be that direct or indirect operating control feedback, on a per-well basis, may be relied on much less since at least some of the dynamic effects of input variations on well mechanical integrity may likely be known a priori according to the earth stress analysis method described herein. While those skilled in the art will recognize that various fluids may be used in injection operations (e.g., steam, carbon dioxide, acid, and natural gas), water will be used henceforth as an exemplary injectant.

Figure 20:
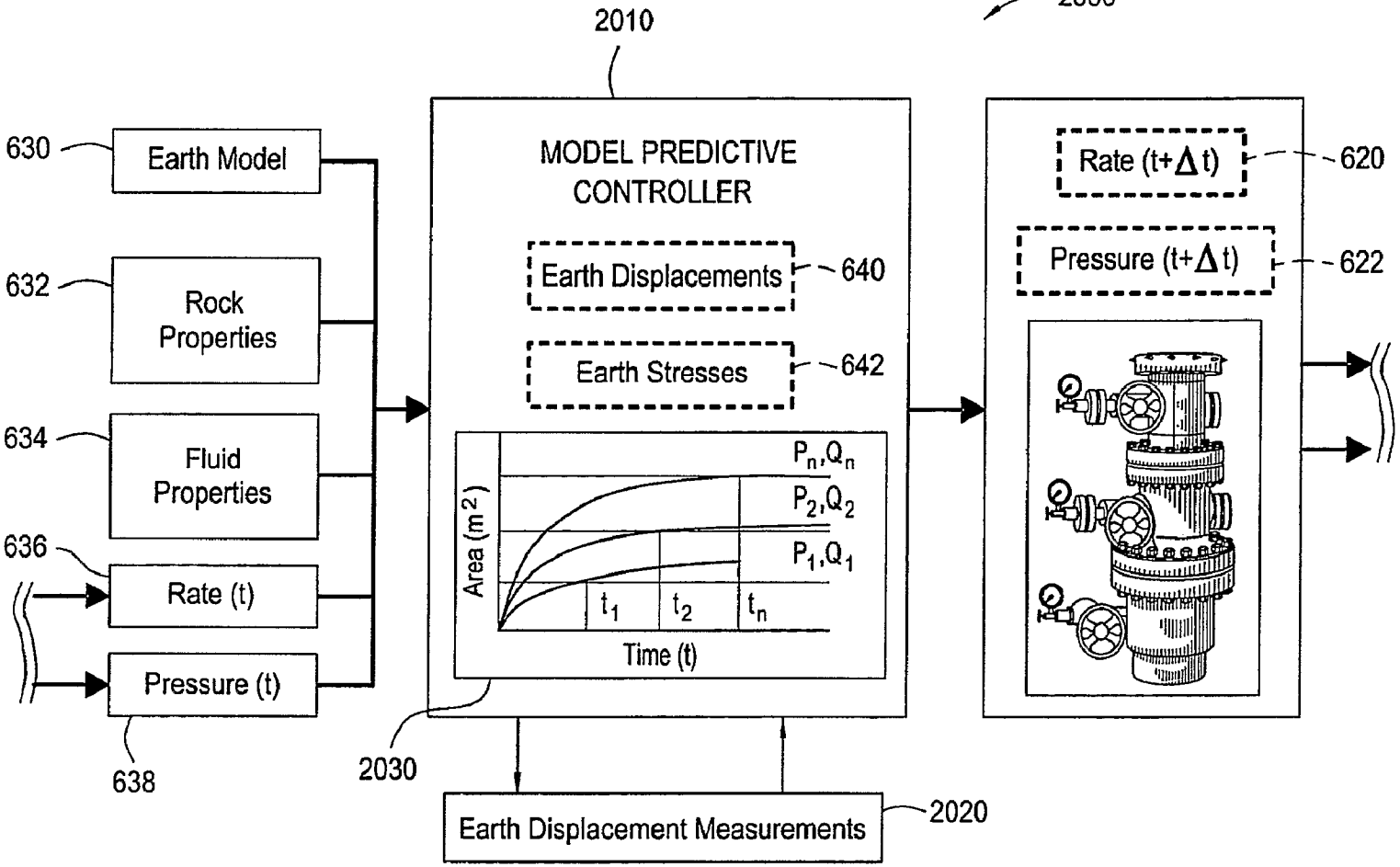
FIG. 20 illustrates an MPC scheme to forecast well operating conditions relative to injection constraints in accordance with an embodiment of the present invention.

FIG. 20 depicts an MPC scheme 2000 to forecast well operating conditions relative to injection constraints. A model predictive controller 2010 may be employed to forecast future injector operating conditions 2030, which may include pressure and/or rate relative to current injection performance. The model predictive controller inputs may include the layered earth model 630 of subterranean lithology, rock properties 632 (e.g., layer elastic properties, layer strength properties), energetic fluid properties 634, and present fluid rate 636 at time t and/or pressure 638 at time t. The outputs may be the forecasted fluid rate at time t+Δt 620 and/or pressure at time t+Δt 622.

Using the inputs, the model predictive controller may uniquely calculate the convolution of fracture growth and adapt tilt array or remote sensing (e.g., InSAR, LiDAR and GPS) of earth displacement measurements 2020 in real-time to constrain the calculation. Calculated fracture growth may then be compared to a target fracture extent, and injection parameters, such as gain, may be adjusted to reduce the error.

Figure 21:
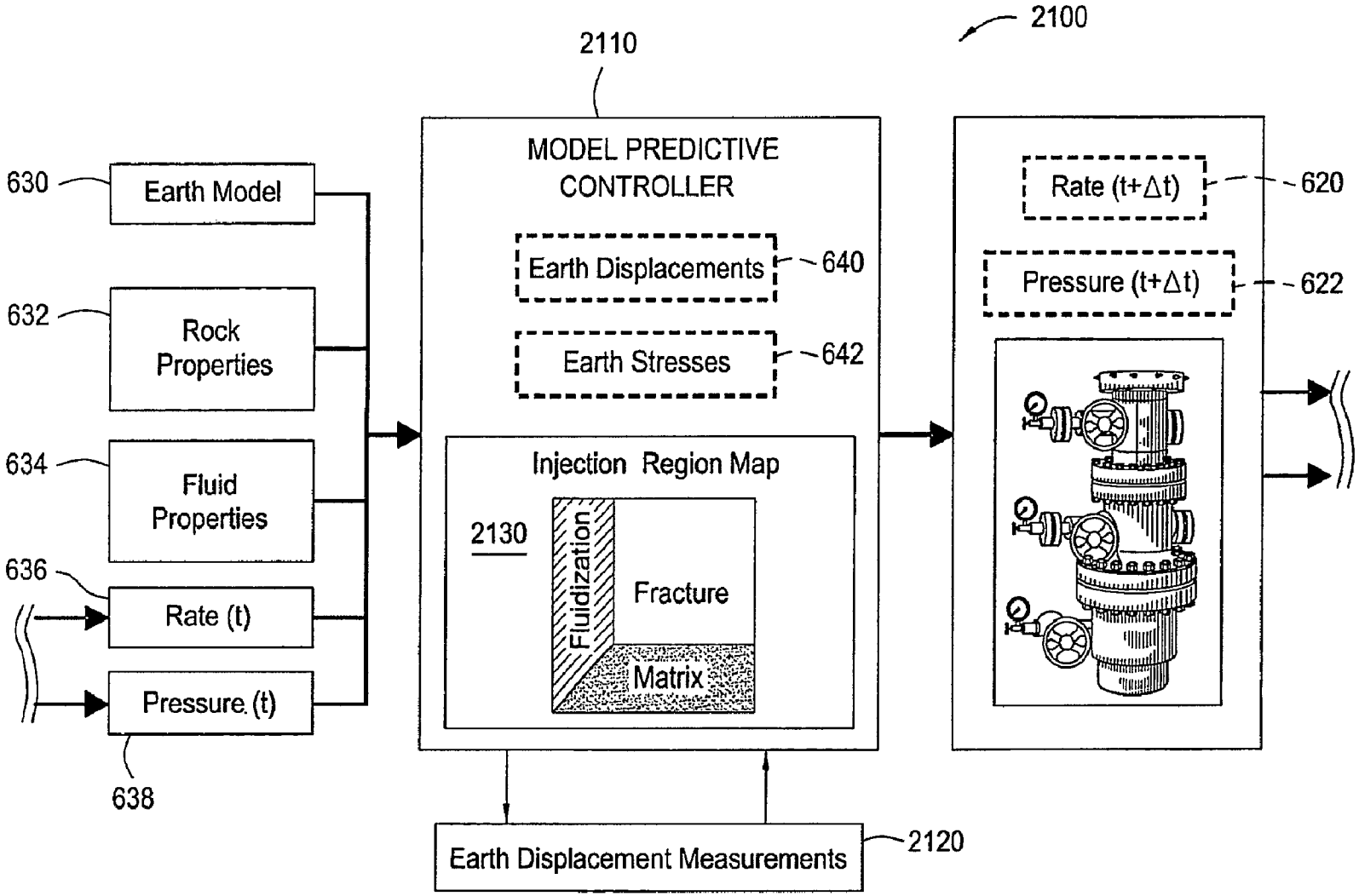
FIG. 21 illustrates an MPC scheme that incorporates earth displacement measurements to self-calibrate in accordance with an embodiment of the present invention.

FIG. 21 depicts an MPC model predictive control scheme 2100, which may employ earth displacement measurements 2120 to self-calibrate. A model predictive controller 2110 may calculate earth displacements 640 and stresses 642 and may predict a likely injection mode 2130 (e.g., matrix injection, fracturing or fluidization). If the mode is matrix injection, a maximum gain may be specified until a change in mode is detected. If the mode is fracturing, the output gain may be predicted iteratively according to a maximum constraint on the calculated convolution of fracture growth. If the mode is fluidization, the model predictive controller 2110 may utilize the measurements of earth surface displacements 2120 to predict the radial and vertical extent of the near-well disturbance. If the extent of the disturbance lies inside bounding strata, the model predictive controller 2110 may continue to forecast a gain in output. However, if the extent approaches bounding strata and pressure predicted within the extent exceeds the strength of the strata, the output may be triggered to a "wait" or "off" state.

Figure 22:
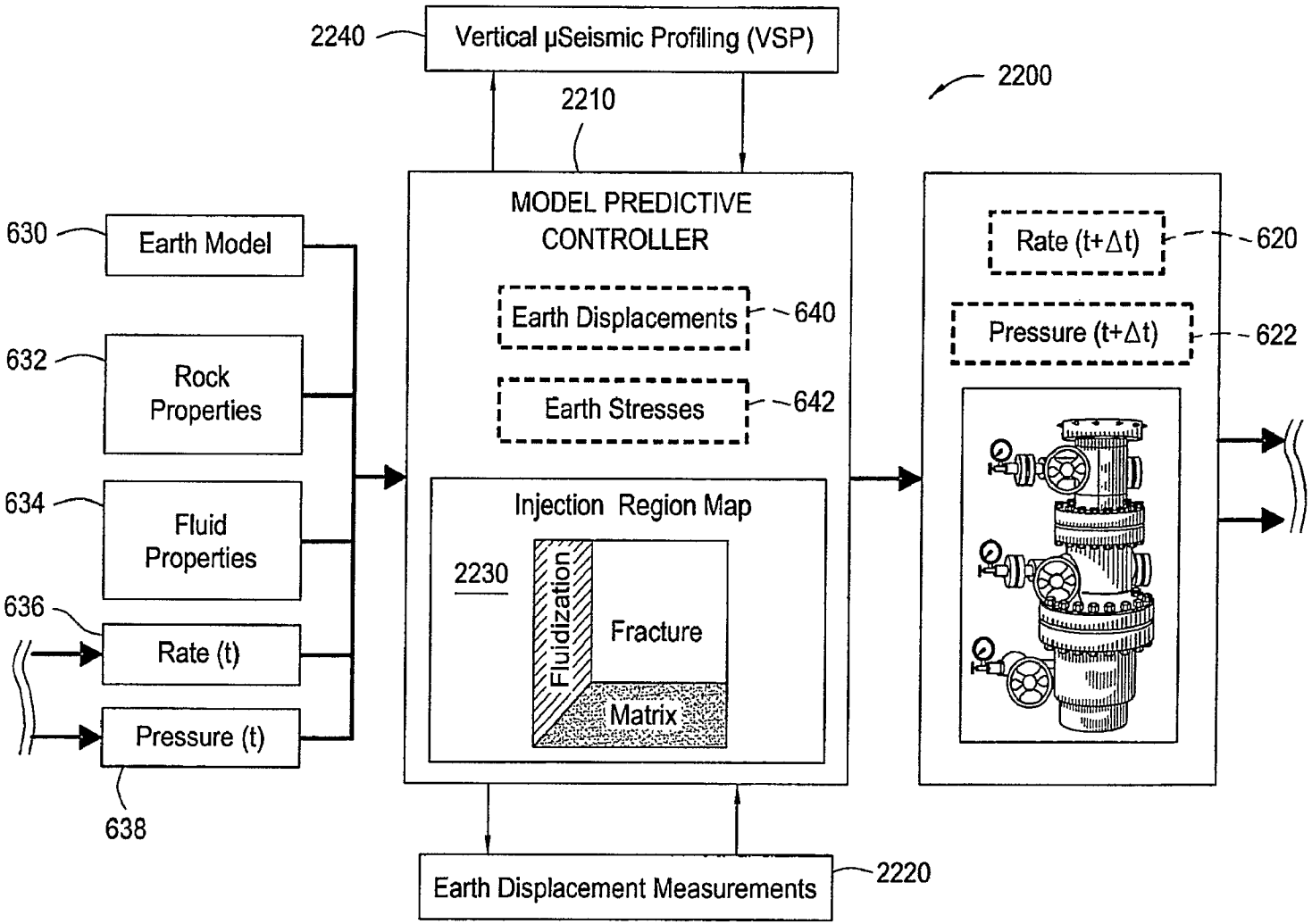
FIG. 22 illustrates an MPC scheme that simultaneously incorporates earth displacement measurements and vertical profiling of μ-seismic events in accordance with an embodiment of the present invention.

In FIG. 22, an MPC scheme 2200 is depicted which may employ earth displacement measurements 2210 and vertical profiling of microseismic (μ-seismic) events 2240. The model predictive controller 2210 may utilize measurements of earth displacements 2210 and vertical profiling of injection-induced μ-seismic events 2240 simultaneously prior to forecasting at time t+Δt. Within the model predictive controller 2210, vertical μ-seismic event profiling may be implemented in an effort to calibrate the forecasted mode of injection and may further constrain the calculated convolution of fracture growth (if in fracturing mode) and extent of any near-well disturbance (if in fluidization mode). Information from the monitoring of events (e.g., source dimension, magnitude, location and elastic strain energy change) may be used to determine at t+Δt when a change in injection mode is expected and whether or not the t+Δt mode turns out to be aseismic (i.e., the rock is more fluidic rather than intact).

Water injection may be managed by a well-located model predictive control (MPC) system. One element of a well-located MPC system is a physics-based control "engine" for transient analysis of formation effective displacement, stress and excess pore pressure field quantities. A strain or stress based systematic method for analysis of the multi-well problem through decomposition of phenomena governing single-well mechanical response, as previously described, may be used in an MPC system to control water injection.

Those skilled in the art should understand that the preferred embodiment herein discloses a control system or process that is preferably implemented for field-wide management of water injection using a suitably programmed digital computer. Such persons could develop a computer software and hardware implementation of the invention based on the methods described herein for management and control of earth stress.

While the foregoing is directed to embodiments of the present invention, other and further embodiments of the invention may be devised without departing from the basic scope thereof, and the scope thereof is determined by the claims that follow.

The invention claimed is:

1. A method for causing a computer processor to assist with management of an impact, on an earth formation, of fluid injection operations associated with hydrocarbon recovery from at least one well formed in the earth formation, the method comprising:

a) generating at least first and second sets of equations to model contributions to the impact of the operations due to at least first and second physical processes associated with the injection operations, wherein the fluid injection operations comprise injecting a fluid into the at least one well and the fluid comprises at least one of steam, water, natural gas, carbon dioxide, polymer, and acid;

b) providing non-transitory computer readable instructions to the computer processor to cause the computer processor to obtain solutions to the first and second sets of equations to determine contributions to the impact of the operations due to the first and second physical processes;

c) combining the solutions to the first and second sets of equations to determine the impact of the operations on the earth formation; and d) adjusting the fluid injection operations of the well based on the combined solutions.

2. The method of claim 1, further comprising:

dividing the well into a plurality of layers;

conducting steps a-c for each of the plurality of layers to generate a plurality of combined solutions for the layers;

superposing the plurality of combined solutions to determine the impact of the operations at the well on the earth formation; and adjusting the fluid injection operations of the well based on the superposed solutions.

3. The method of claim 1, further comprising:

repeating steps a-c for a plurality of wells to generate a plurality of combined solutions for the wells;

superposing the plurality of combined solutions to determine a field-level impact of the operations on the earth formation; and adjusting the fluid injection operations of the plurality of wells based on the superposed solutions.

4. The method of claim 1, further comprising:

e) dividing the well into a plurality of layers;

f) conducting steps a-c for each of the plurality of layers to generate a plurality of combined solutions for the layers;

g) superposing the plurality of combined solutions for the layers to determine the impact of the operations at the well on the earth formation;

h) repeating steps e-g for a plurality of wells to generate a plurality of combined solutions for the wells;

i) superposing the plurality of combined solutions for the wells to determine a field-level impact of the operations on the earth formation; and j) adjusting the fluid injection operations of the plurality of wells based on the superposed solutions for the wells.

5. The method of claim 1, further comprising forecasting an injection mode of the fluid injection operations.

6. The method of claim 5, wherein the forecasted mode is matrix injection.

7. The method of claim 6, further comprising specifying a maximum gain in output for the fluid injection operations until a change is detected in one or more parameters comprising at least one of the earth formation, the earth displacement measurements, a rate of flow coming out of the earth formation, a pressure for a flow coming out of the earth formation, and data gathered while monitoring the fluid injection operations.

8. The method of claim 5, wherein the forecasted mode is fracturing.

9. The method of claim 8, further comprising:

calculating a convolution of fracture growth based on stored and collected data regarding at least one of the earth surface displacement measurements, rock properties of the earth formation, a pressure of a fluid being recovered from the earth formation; a rate at which the fluid is being recovered from the formation, and the data gathered while monitoring the fluid injection operations;

determining a maximum constraint on the convolution of fracture growth; and iteratively predicting an output gain according to the maximum constraint.

10. The method of claim 5, wherein the forecasted mode is fluidization.

11. The method of claim 10, further comprising:

adapting the earth surface displacement measurements for prediction;

predicting a radial portion of an extent of a disturbance caused by the fluidization;

predicting a vertical portion of the extent of the disturbance;

determining if the extent of the disturbance approaches bounding strata;

determining if a predicted pressure within the extent of the disturbance exceeds the strength of the strata; and temporarily halting the fluid injection operations if the extent of the disturbance approaches bounding strata and the predicted pressure exceeds the strength of the strata.

12. The method of claim 5, further comprising:

collecting vertical microseismic event data;

implementing microseismic event profiling; and updating the forecasted mode based on the event profiling.

13. The method of claim 12, wherein updating the forecasted mode based on the microseismic event profiling comprises constraining a calculated convolution of fracture growth using the event profiling if the forecasted mode is fracturing or constraining an extent of any disturbances near the well using the event profiling if the forecasted mode is fluidization.

14. The method of claim 5, further comprising using earth surface displacement measurements and data gathered while monitoring the fluid injection operations to update the forecasted mode and adjust the fluid injection operations.

15. The method of claim 14, wherein using the earth surface displacements measurements and the data comprises:

collecting the earth surface displacement measurements from one or more tilt arrays or remote sensing devices;

calculating fracture growth using the earth surface displacement measurements;

comparing the calculated fracture growth to a target fracture extent; and adjusting an output gain of the fluid injection operations.

16. The method of claim 15, wherein the one or more remote sensing devices comprise at least one of Interferometric Synthetic Aperture Radar (InSAR), Light Detection and Ranging (LiDAR), and Global Positioning System (GPS) devices.

17. The method of claim 14, further comprising using the data gathered while monitoring the fluid injection operations to determine when a change in injection mode is expected and whether the forecasted injection mode is aseismic.

18. A non-transitory computer-readable medium containing computer instructions stored therein for causing a computer processor to perform management of an impact, on an earth formation, of fluid injection operations associated with hydrocarbon recovery from at least one well formed in the earth formation, which when executed performs operations comprising:

generating at least first and second sets of equations to model contributions to the impact of the operations due to at least first and second physical processes associated with the injection operations, wherein the fluid injection operations comprise injecting a fluid into the at least one well and the fluid comprises at least one of steam, natural gas, carbon dioxide, and acid;

obtaining solutions to the first and second sets of equations to determine contributions to the impact of the operations due to the first and second physical processes;

combining the solutions to the first and second sets of equations to determine the impact of the operations on the earth formation; and adjusting the fluid injection operations at the well based on the combined solutions.

19. A system for managing an impact, on an earth formation, of fluid injection operations associated with hydrocarbon recovery from at least one well formed in the earth formation, the system comprising:

a processing unit configured to generate at least first and second sets of equations to model contributions to the impact of the operations due to at least first and second physical processes associated with the injection operations, wherein the fluid injection operations comprise injecting a fluid into the at least one well and the fluid comprises at least one of steam, natural gas, carbon dioxide, and acid; obtain solutions to the first and second sets of equations to determine contributions to the impact of the operations due to the first and second physical processes; combine the solutions to the first and second sets of equations to determine the impact of the operations on the earth formation; and adjust the fluid injection operations at the well based on the combined solutions.

* * * * *